US007258420B2

(12) United States Patent
Hiraki

(10) Patent No.: US 7,258,420 B2
(45) Date of Patent: Aug. 21, 2007

(54) INKJET PRINTER

(75) Inventor: Nobuo Hiraki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 371 days.

(21) Appl. No.: 11/073,743

(22) Filed: Mar. 8, 2005

(65) Prior Publication Data

US 2005/0195240 A1 Sep. 8, 2005

(30) Foreign Application Priority Data

Mar. 8, 2004 (JP) ..... P2004-064569

(51) Int. Cl.
*B41J 2/165* (2006.01)

(52) U.S. Cl. ..... 347/33

(58) Field of Classification Search ..... 347/29, 347/32, 33

See application file for complete search history.

(56) References Cited

U.S. PATENT DOCUMENTS 5,663,751 A * 9/1997 Holbrook ..... 347/22
5,793,391 A * 8/1998 Kawakami et al. ..... 347/33
6,505,924 B2 1/2003 Shimizu
6,739,707 B2 5/2004 Shimizu et al.
2001/0040612 A1 11/2001 Shimizu
2004/0189754 A1 9/2004 Shimizu et al.

FOREIGN PATENT DOCUMENTS

JP 2000103069 4/2000

* cited by examiner

*Primary Examiner*—Shih-wen Hsieh
(74) *Attorney, Agent, or Firm*—Banner & Witcoff, Ltd

(57) ABSTRACT

In a case where a home position of a carriage and a maintenance position are set on the same side while a wiper is taken as a border, when the carriage at the home position moves for performing recording on a recording medium, a cam is driven so as to cause a release section to move the wiper from a wiping position to a receded position before the carriage moves. Thereafter, movement of the carriage is started. When wiping of a recording head by means of the wiper is not required, by means of returning the wiper to the receded position in advance, unnecessary contact between the wiper and the recording head can be prevented.

14 Claims, 23 Drawing Sheets

INKJET PRINTER

BACKGROUND OF THE INVENTION

1.Field of the Invention

The present invention relates to an inkjet printer having a wiper for wiping a nozzle face of a recording head.

2. Description of the Related Art

An example of an inkjet printer having a wiper for wiping a nozzle face of a recording head is disclosed in JP-A-2000-103069. The inkjet printer is configured such that a carriage having the recording head reciprocates and such that a wiper is disposed at an arbitrary position along a moving path of the carriage. The wiper is displaced by a cam from a receded position where the wiper recedes from the recording head to a wiping position where the wiper is brought into contact with the recording head, to thus perform a wiping operation. When the carriage is at a maintenance position, the wiper is hooked by a latching section, thereby being held at the wiping position.

When a nozzle face of the recording head is wiped, the wiper held at the wiping position wipes off ink adhering to the recording head during the course of the carriage moving from the maintenance position to the wiper. Thereafter, when the carriage moves in reverse from above, to the maintenance position, the carriage abuts the wiper, thereby releasing the wiper from the latching section. Accordingly, restoration force of a spring urges the wiper to return from the wiping position to the receded position.

SUMMARY OF THE INVENTION

In an inkjet printer having such a wiper as above, when the wiper is taken as a border and a home position of the carriage and the maintenance position are set on the same side, the following problems arise.

In an inkjet printer configured as above, when the carriage reaches a receded position en route to the home position after passing through a position of the wiper, an operation of a cam moves the wiper to an elevated position, whereby the wiper remains held at the wiping position until the carriage drops the wiper from the hooked state. Accordingly, when the carriage moves for performing recording on a recording medium and passes by the wiper, the wiper is brought into contact with the recording head. Hence, a wiping operation is performed in spite of the recording head not requiring wiping. The unnecessary contact of the wiper with the recording head shortens a service life of the recording head.

To this end, the following measure has been taken. Namely, a rib for dropping the wiper is disposed at a position closer to a recording region than to the carriage. When the wiper passes beyond the rib, motion of the recording head is temporarily stopped, and the carriage is moved toward the maintenance position again, thereby dropping the wiper. However, according to this measure, the carriage must be temporarily stopped after having started moving, and must be slightly moved backward. This raises a problem of a period of time required for recording becoming longer.

It is therefore one of objects of the present invention to provide an inkjet printer having a recording head a durability of which being enhanced.

According to a first aspect of the invention, there is provided an inkjet printer including: a carriage that has a recording head and moves reciprocatively along a moving path between a maintenance position and a recording position; a wiper disposed at a position along the moving path and performs a wiping operation to wipe the recording head to remove ink adhering to the recording head; and a cam that displaces the wiper between a receded position where the wiper recedes from the recording head and a wiping position where the wiper is brought into contact with the recording head to perform the wiping operation, wherein the wiper is retained in the wiping position to perform the wiping operation when the carriage moves from the maintenance position to the recording position, wherein the wiper interferes with the carriage and is displaced from the wiping position to the receded position when the carriage moves from the recording position to the maintenance position, and wherein the cam is provided with a release section that engages with the wiper and displaces the wiper from the wiping position to the receded position.

According to a second aspect of the invention, there is provided an inkjet printer including: a carriage that has a recording head and moves reciprocatively along a moving path between a maintenance position and a recording position; a wiper disposed at a position along the moving path and between the maintenance position and the recording position, the wiper that performs a wiping operation to wipe the recording head to remove ink adhering to the recording head; and a cam that displaces the wiper between a receded position where the wiper recedes from the recording head and a wiping position where the wiper is brought into contact with the recording head to perform the wiping operation, wherein the wiper is retained in the wiping position to perform the wiping operation when the carriage moves from the maintenance position to the recording position, wherein the wiper interferes with the carriage and is displaced from the wiping position to the receded position when the carriage moves from the recording position to the maintenance position, and wherein the cam is provided with a release section that engages with the wiper and displaces the wiper from the wiping position to the receded position when the carriage moves from the maintenance position to the recording position after a maintenance operation following the wiping operation is performed to the recording head at the maintenance position while the wiper is displaced to the wiping position.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Hereinbelow, an embodiment of the present invention will be described with reference to FIGS. 1 to 23.

General Configuration

Figure 1:
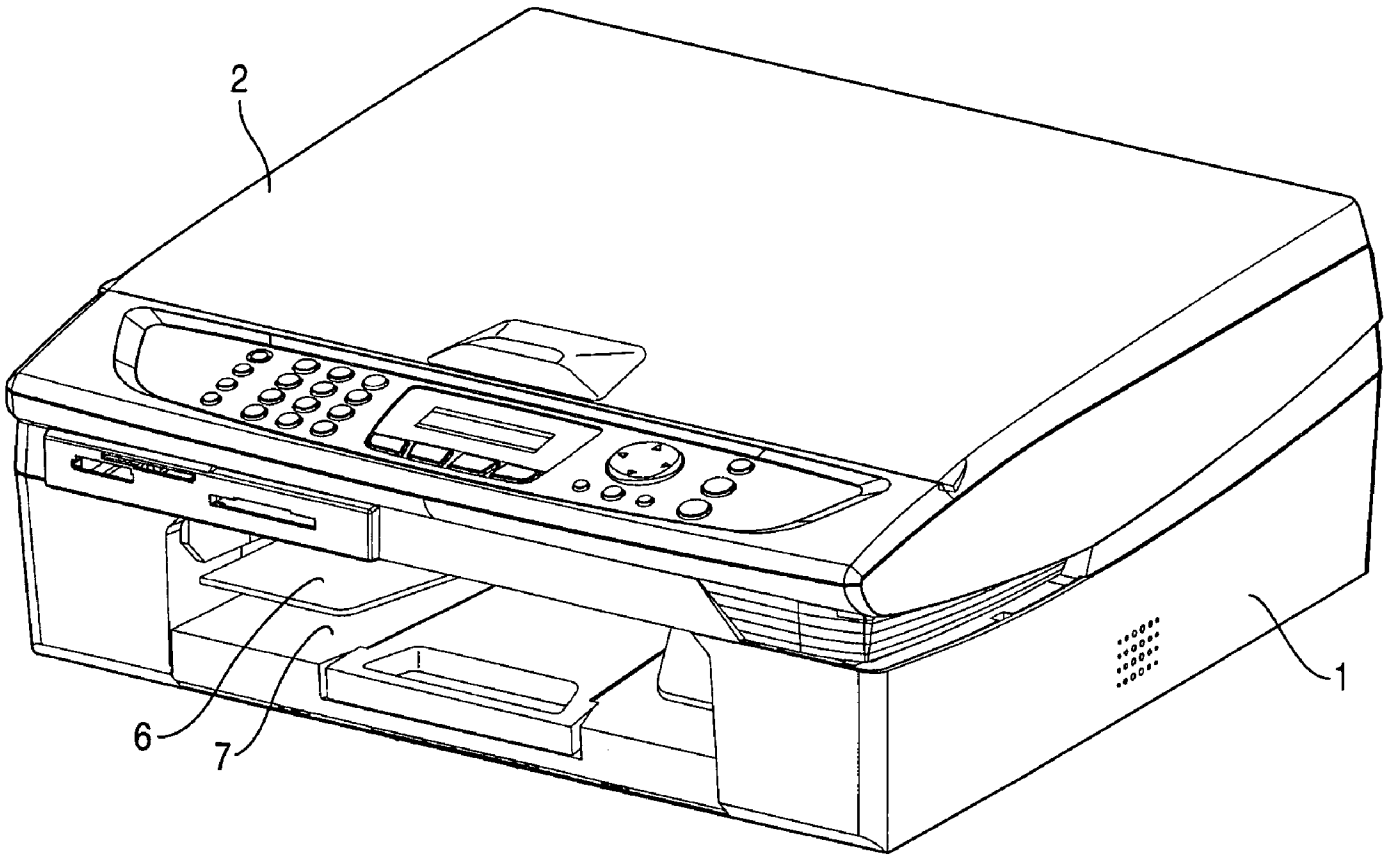
FIG. 1 is an external perspective view of an inkjet printer of the present invention.
Figure 2:
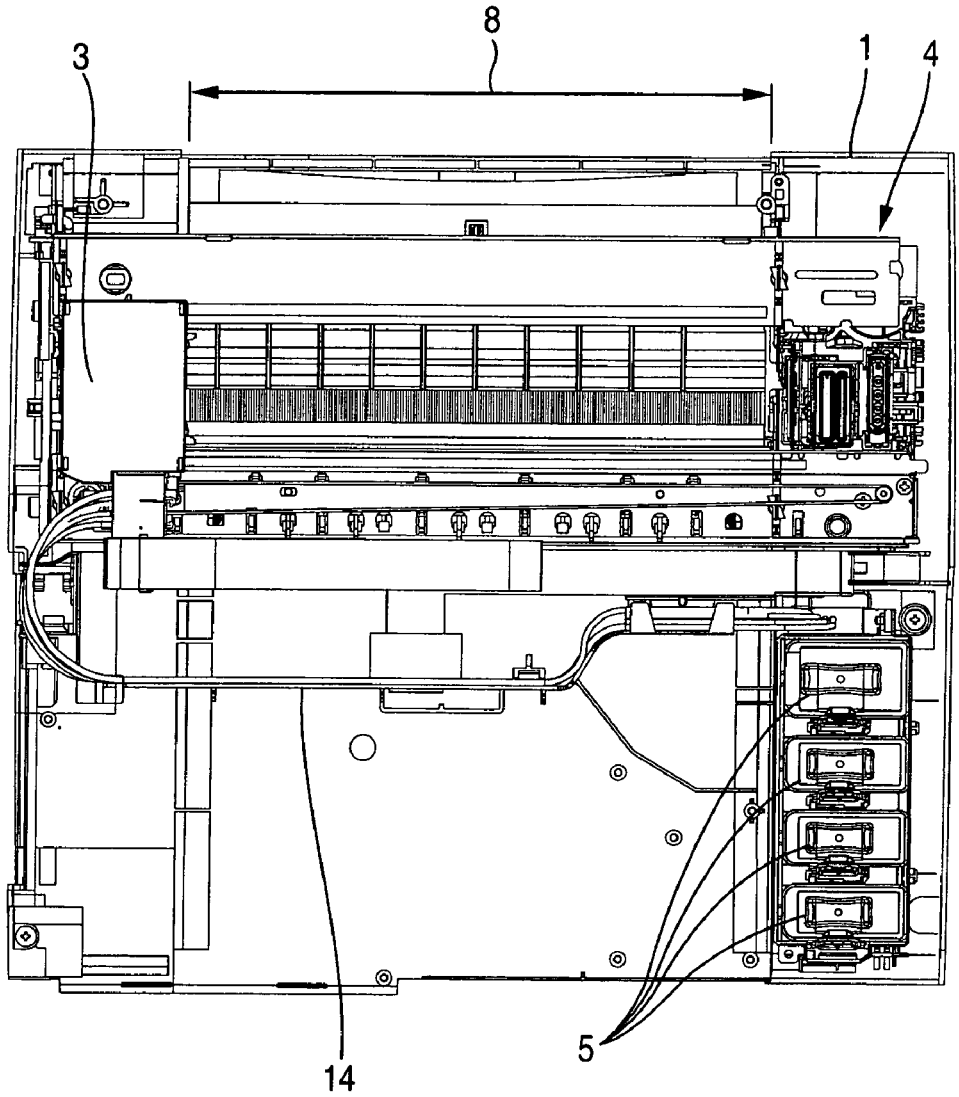
FIG. 2 is a plan view for showing the overall configuration of an internal mechanism of the inkjet printer.

An inkjet printer of the embodiment has a printer function, a copying function, a scanner function, and a facsimile function. As shown in FIGS. 1 and 2, the inkjet printer is configured such that a document reading device 2 used in the copying function and the scanner function is provided on a top face of a main body frame 1; and, below the document reading device 2, there are provided a carriage 3 for recording, a maintenance unit 4 for unclogging a recording head 10, which will be described later, and ink tanks 5 for supplying ink to the recording head 10. Further, a paper delivery tray 6 and a paper feed tray 7 are disposed on the front of the main body frame 1. The carriage 3 is configured to reciprocate laterally. An elongated region ranging from a left end to a right end of a moving path of the carriage 3 serves as a recording region; and the right end section of the moving path serves as a maintenance position (i.e., a home position) where the maintenance unit 4 is disposed. In addition, ink tanks 5 (ink cartridges) of four colors consisting of black, cyan, magenta, and yellow are arranged side by side at a position forward (toward the front) of the maintenance position.

Carriage 3 and Method for Supplying Ink to Carriage 3

Figure 23:
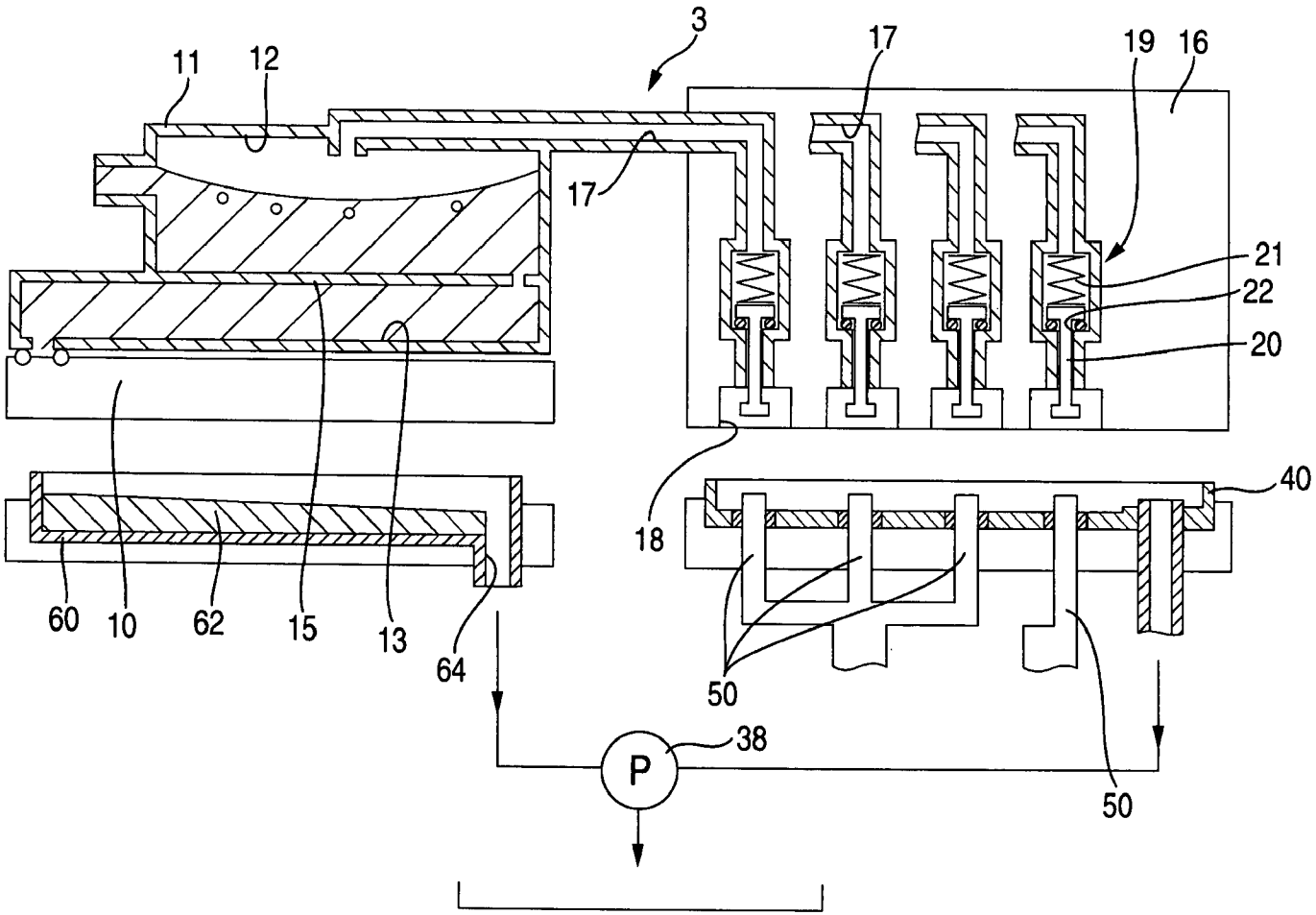
FIG. 23 is a schematic cross-sectional view of the carriage.

As shown in FIG. 23, the carriage 3 has four recording heads 10, each having a number of nozzles on its bottom face. The carriage 3 is configured such that ink is downwardly ejected through nozzles of each of the recording heads during the course of the carriage 3 running through a recording region 8, thereby performing recording (printing) on a recording medium (printing paper). The nozzles of the recording head 10 for black ink are disposed in a rectangular region which is elongated in the front-rear direction. Three recording heads 10 for color inks; that is, for cyan, magenta, and yellow ink, are arranged side by side in a region to the left of the recording head 10 for black ink. The same numbers of nozzles are provided for cyan, magenta, and yellow inks; and a greater number of nozzles are provided for black ink.

A buffer tank 11 is disposed on the top face of each of the recording heads 10. Each of the buffer tanks 11 has a bubble reservoir 12 in its upper portion, and an ink-flow chamber 13 in its lower portion. Ink is supplied into the bubble reservoir 12 from the ink tank 5 by way of a flexible tube 14 (see FIG. 2). The ink having been supplied into the bubble reservoir 12 passes through a filter 15, flows into the ink-flow chamber 13, and reaches the recording head 10. During passage of the ink through the filter 15, bubbles contained in the ink are separated, to thereby be stored in the upper portion of the bubble reservoir 12.

The carriage 3 includes a valve case 16 located rightward of the recording head 10. Discharge paths 17 serving as discharge ports 18 are opened in the bottom face of the valve case 16, and each of the discharge paths 17 extends from an inside top face of the respective bubble reservoir 12. The four discharge ports 18 are aligned in the front-rear direction. The four discharge paths 17 extend vertically inside the valve case 16. A normally-closed valve 19 is disposed in each of the vertically-extended portions. The valve 19 is configured as follows. During normal times, a vertically-elongated valve body 20 seals a valve port 22 by means of a spring (urging member) 21, thereby maintaining the valve 19 in a valve-closed state where the valve body 20 is sealed. However, when the valve body 20 moves upward against a restoration force of the spring 21, the valve 19 is opened. In relation to resistance against air discharge (hereinafter called "air-discharge resistance") in the air-discharge paths (which will be detailed later) ranging from the bubble reservoir 12 to the discharge port 18 of the discharge path 17, the air-discharge path for cyan, that for yellow, and that for magenta have essentially the same level of air-discharge resistance. Meanwhile, the air-discharge path for black ink is lower than the air-discharge paths for color inks in terms of the level of air-discharge resistance.

The carriage 3 is configured so as to be capable of stopping at a home position, an uncapped suction position, and a wiping-termination position. The home position is at the rightward end in the reciprocating path. The non-capped position is located slightly leftward (closer to the recording region 8) of the home position, and rightward of a wiper 90. The wiping-termination position is located slightly leftward of the wiper 90.

Drive Power Transmission Mechanism of Maintenance Unit 4

Figure 3:
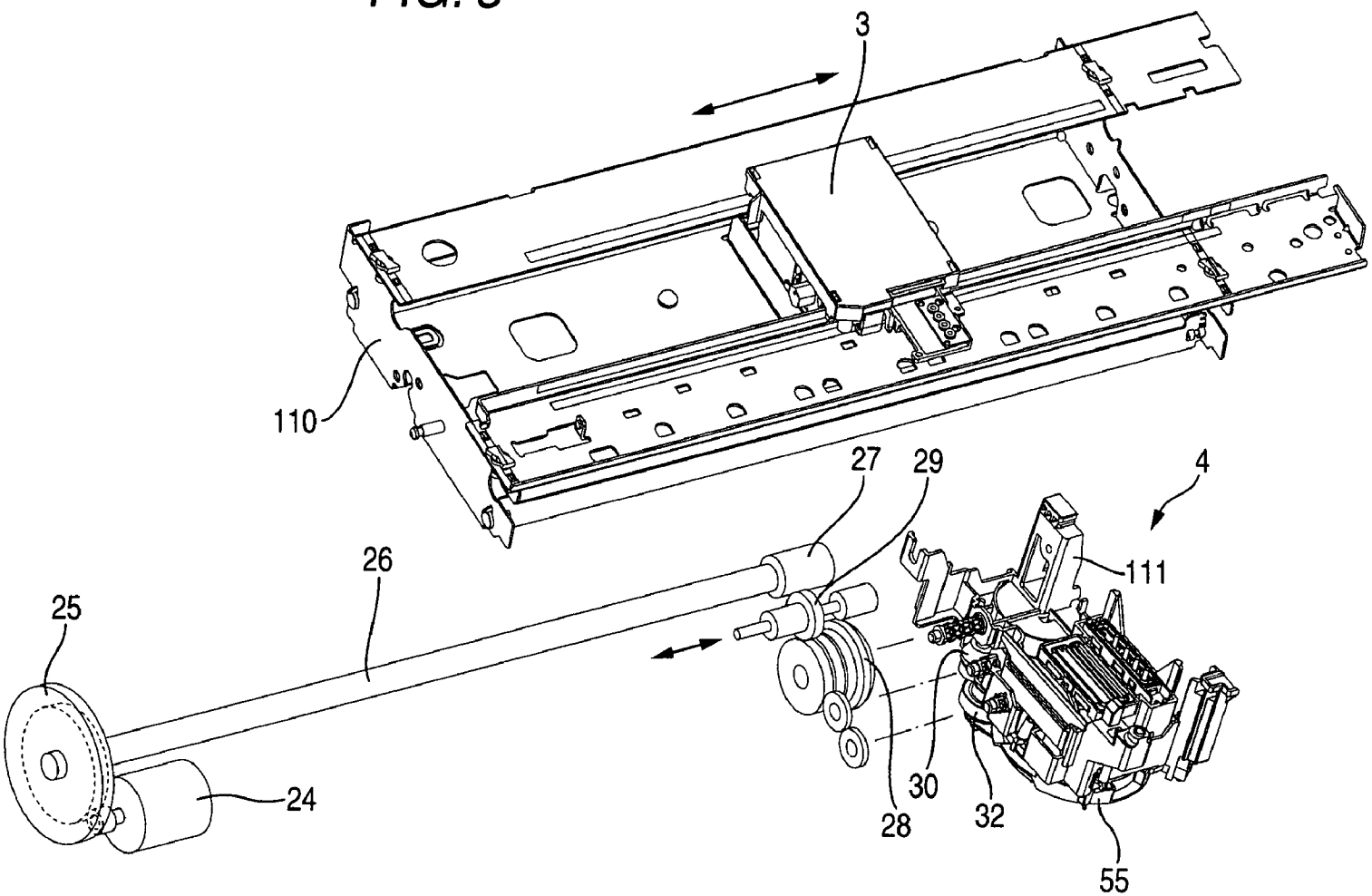
FIG. 3 is a perspective view showing a mechanism for transmitting rotational drive power to a maintenance mechanism.
Figure 4:
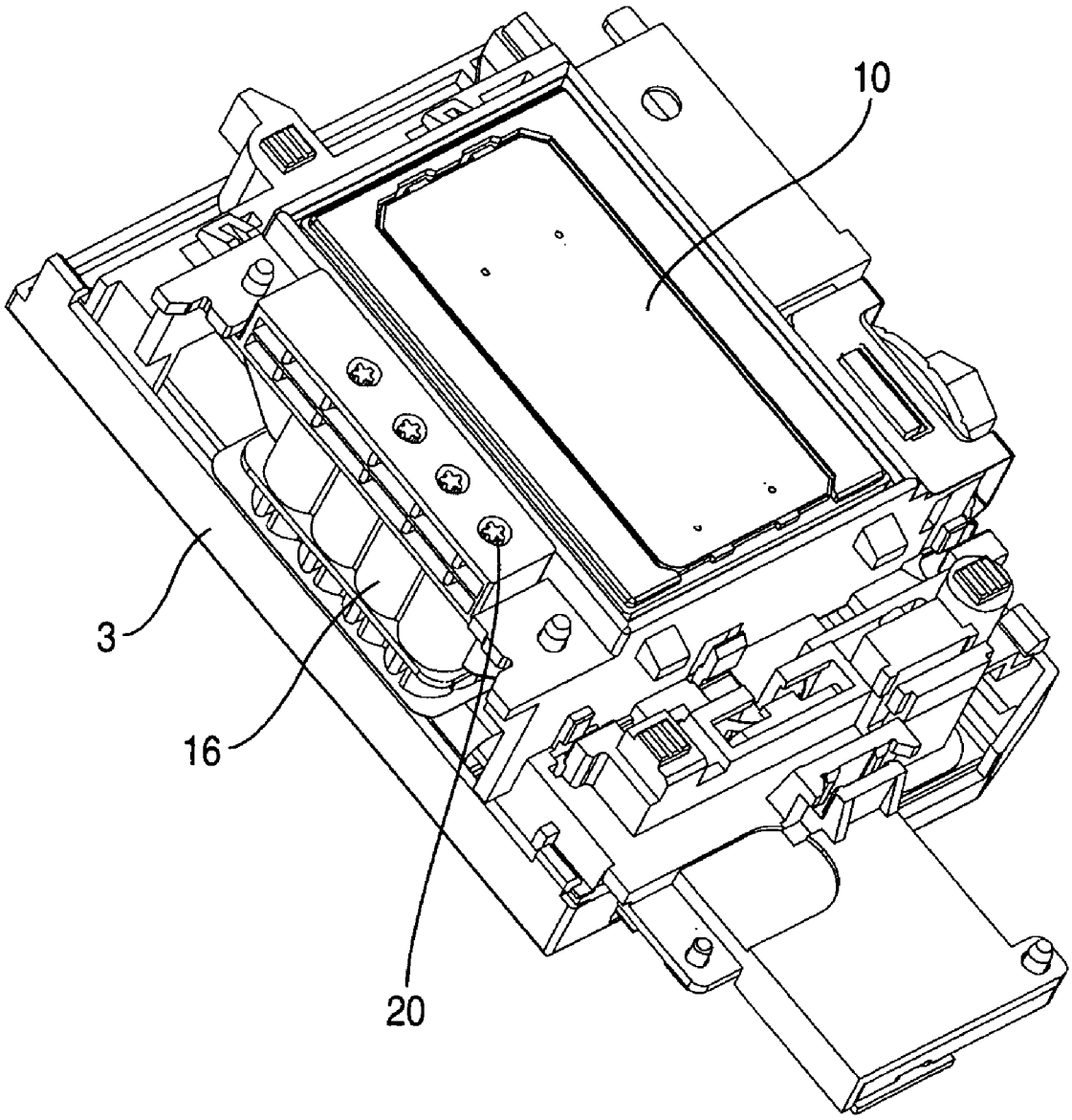
FIG. 4 is a perspective view of a carriage in an inverted state.

In a carriage frame 110, as shown in FIG. 3, a rotational drive mechanism is provided as means for rotating a paper feed roller (not shown). The rotational drive mechanism has a motor 24 disposed in a left end section of the carriage frame 110. A rotation shaft 26 of a reduction gear 25 engaged with an output shaft of the motor 24 extends rightward for a long distance. A drive gear 27 is disposed on a right end section of the rotation shaft 26 so as to rotate integrally with the rotation shaft 26. A slide gear 29, which engages with a large-diameter bevel gear 28 only when the carriage 3 is moved to the maintenance position, is engaged with the drive gear 27. The large-diameter bevel gear 28 is engaged with a small-diameter bevel gear 30 whose axis is oriented vertically.

Figure 5:
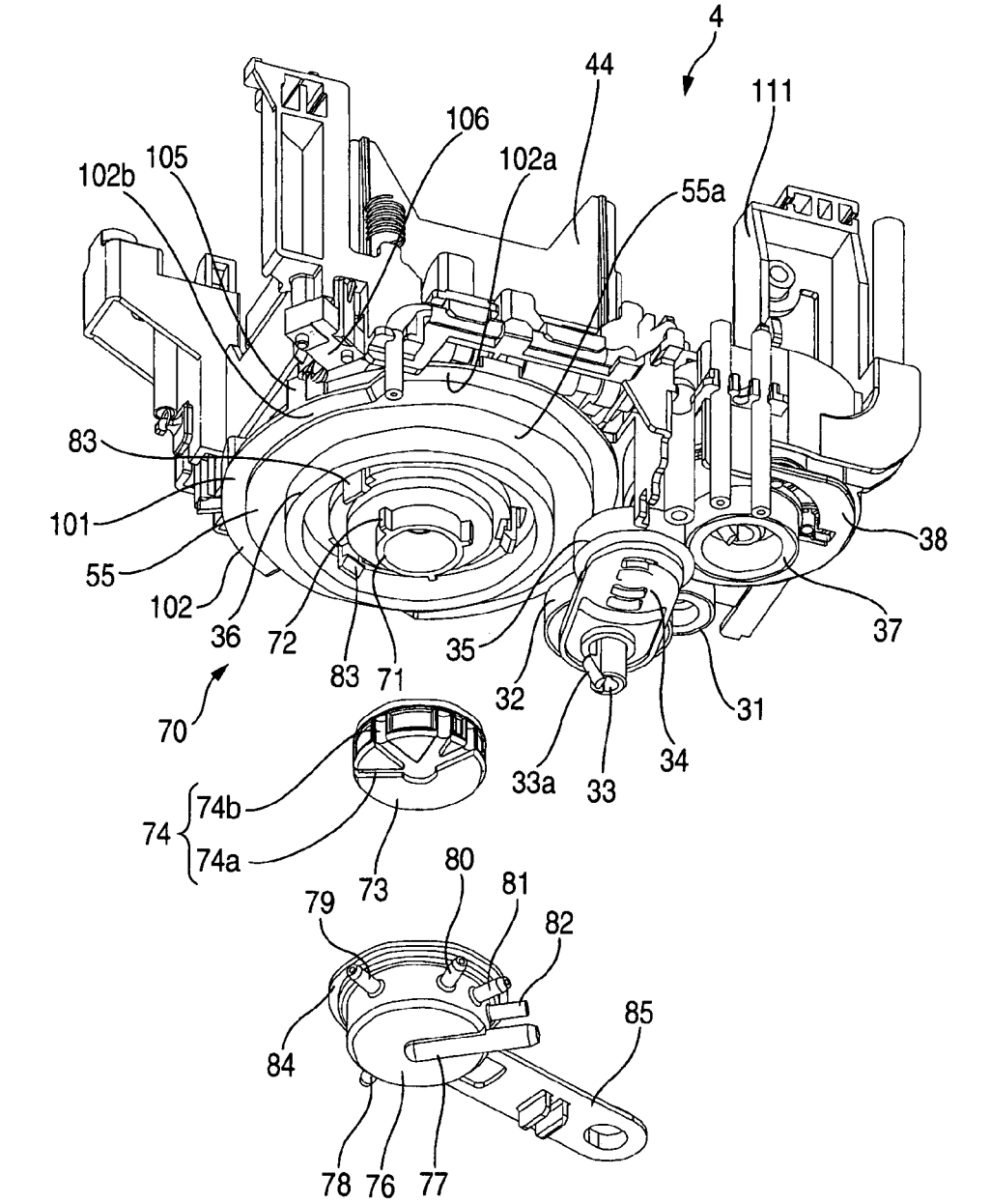
FIG. 5 is a perspective view of the maintenance mechanism as viewed from the bottom side.
Figure 6:
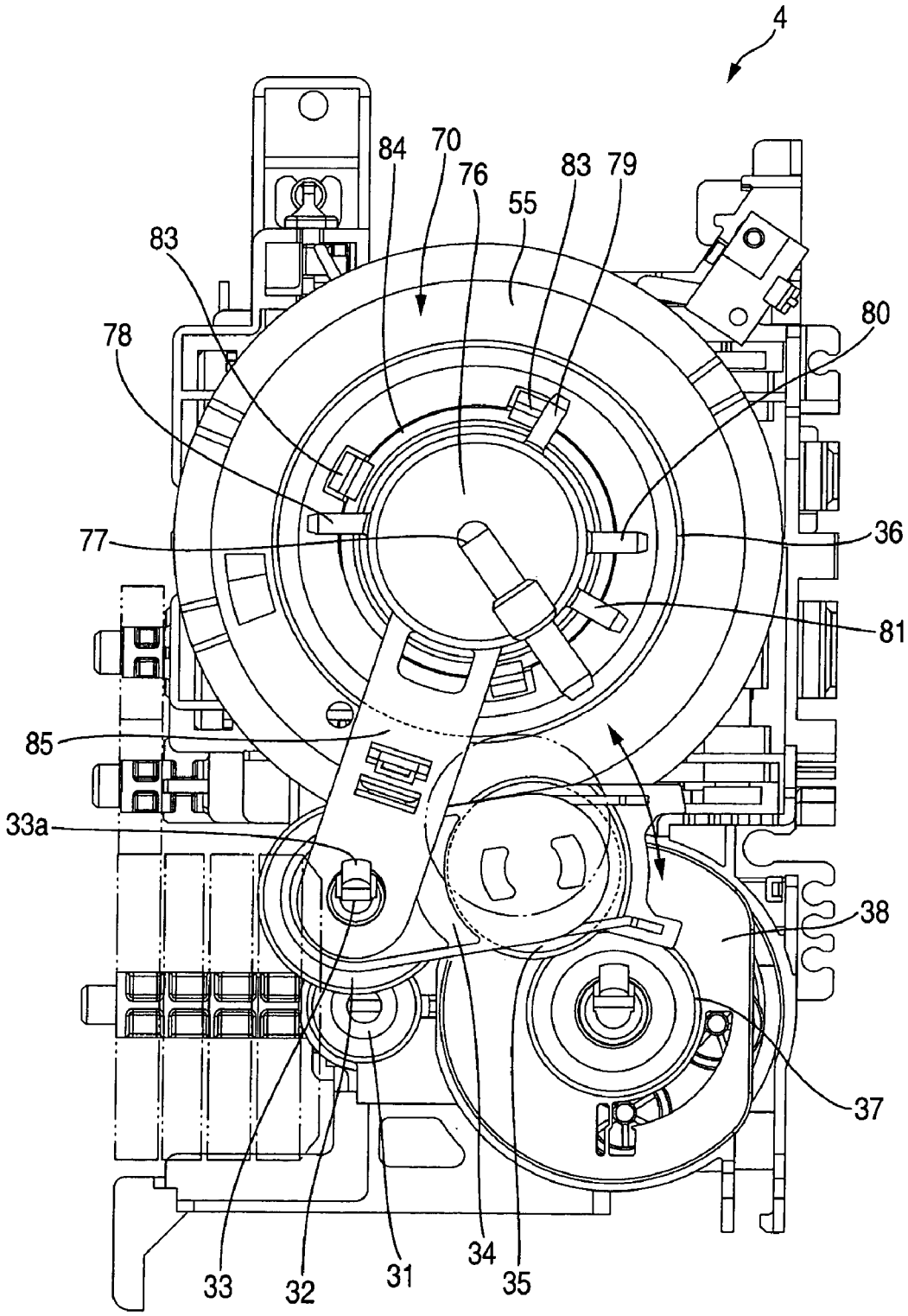
FIG. 6 is a bottom view of the maintenance mechanism.
Figure 7:
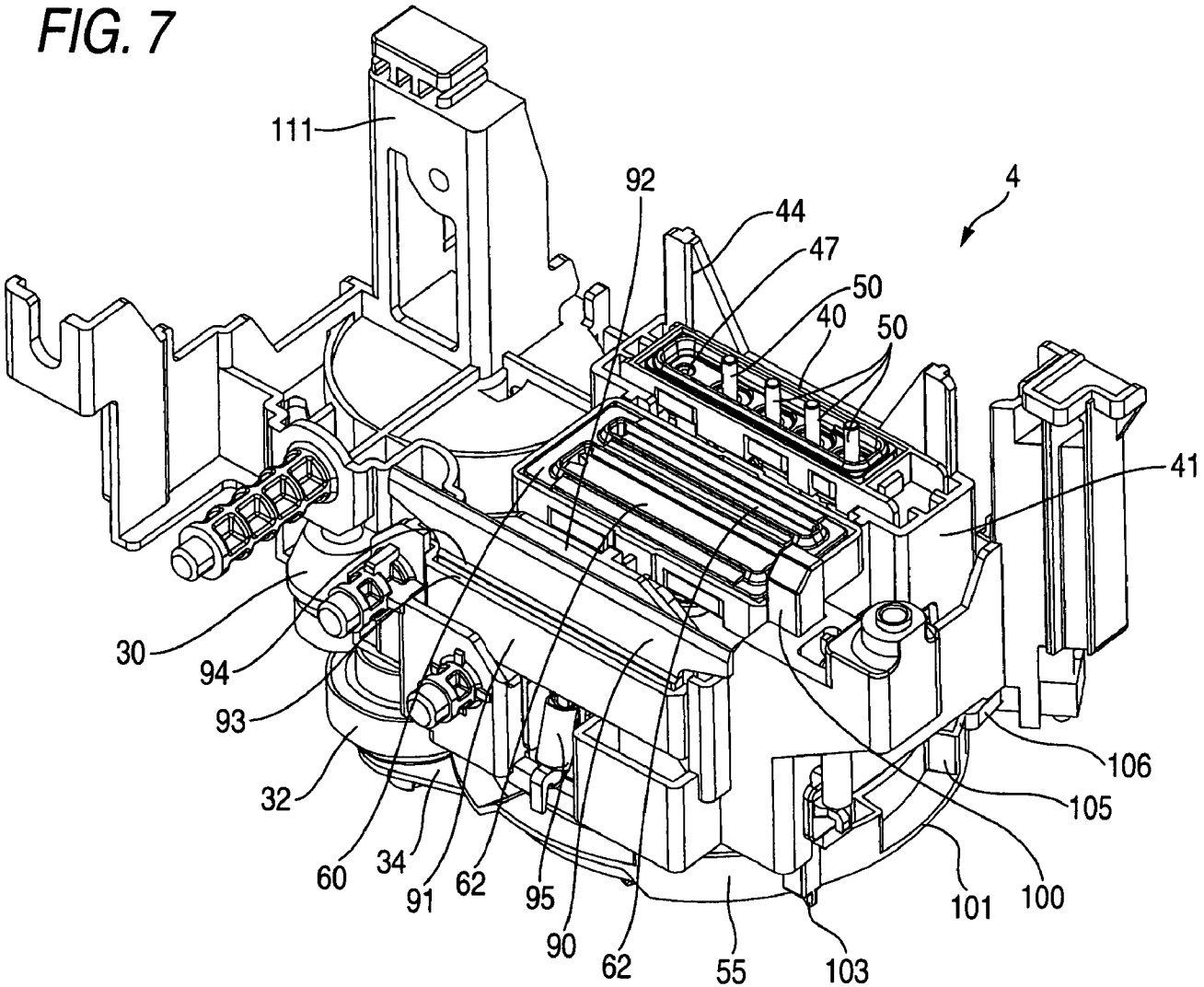
FIG. 7 is a perspective view of the maintenance mechanism as viewed from the top.

The small-diameter bevel gear 30 is engaged with a sun gear 32 by way of a reduction gear 31. As shown in FIGS. 5 and 6, one end of a swivel arm 34 is attached to a shaft 33 of the sun gear 32 and can rotate relative to the shaft 33. Onto the other end of the swivel arm 34, a planetary gear 35 is attached and can rotate relative to the swivel arm 34. The planetary gear 35 is engaged with the sun gear 32. Frontward of the planetary gear 35, a disk-shaped cam 55 whose axis is parallel with those of the sun gear 32 and the planetary gear 35; that is, whose axis is oriented vertically, is supported on a maintenance frame 111 (a frame which is an element of the invention). A driven gear 36 identical in height with the planetary gear 35 is formed integrally with the cam 55. The cam 55 will be described in detail later.

Incidentally, rearward of the planetary gear 35, a pump gear 37 is rotationally supported by the maintenance frame 111 at a height identical with that of the planetary gear 35. When the pump gear 37 rotates, a rotary-type pump 38 (suction means which is an element of the invention) is activated to thus perform a suction operation.

When the sun gear 32 rotates counterclockwise in FIG. 6, which is a bottom view, the planetary gear 35 revolves counterclockwise about the sun gear 32, to thus be engaged with the driven gear 36 of the cam 55; and the cam 55 is driven to rotate counterclockwise (clockwise in top view). In contrast, when the sun gear 32 rotates clockwise, the planetary gear 35 revolves clockwise about the sun gear 32, to thus be engaged with the pump gear 37; and the pump 38 is driven to rotate, to thus perform a suction operation. Accordingly, a rotational direction of the cam 55 is counterclockwise in FIG. 6 (clockwise in FIGS. 12 and 13) in all cases.

Air-Discharge Cap 40 of Maintenance Unit 4

Figure 8:
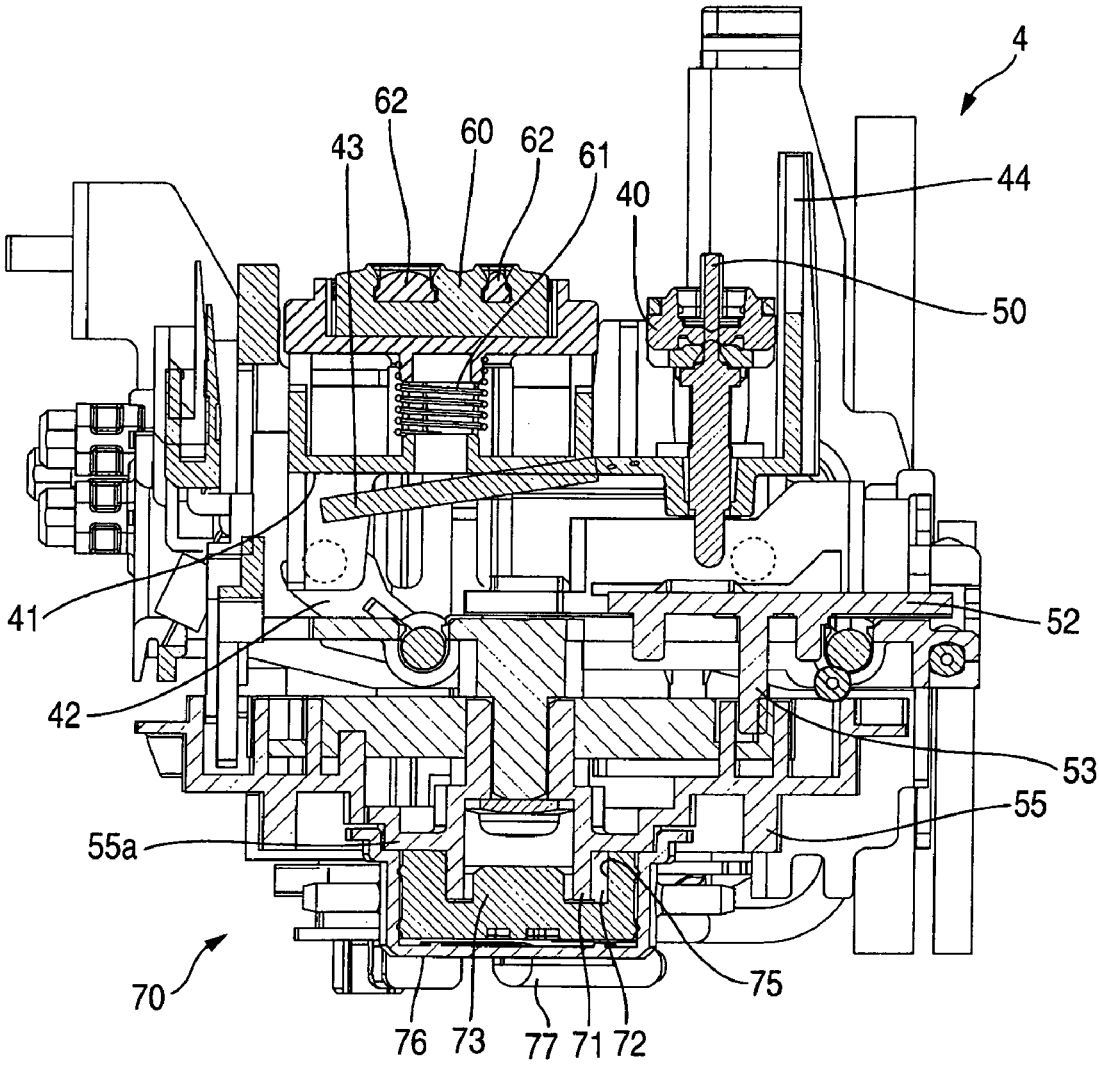
FIG. 8 is a schematic cross-sectional view showing a state where a cap is at a receded position, a reclosable member is at a valve-closing position, and a wiper is at a receded position.
Figure 9:
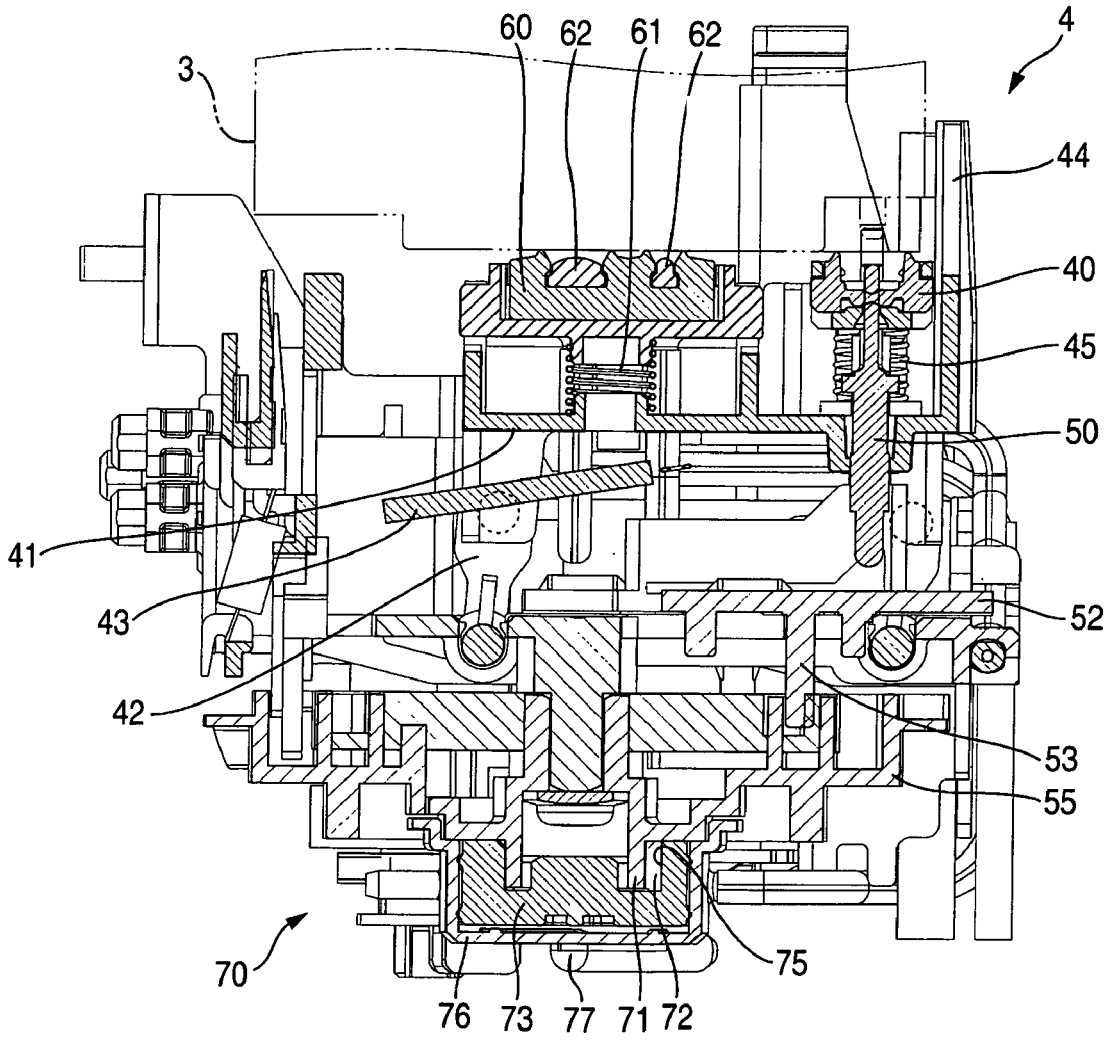
FIG. 9 is a schematic cross-sectional view showing a state where a cap is at an home position, and an air-discharge cap is in close contact with the carriage.
Figure 10:
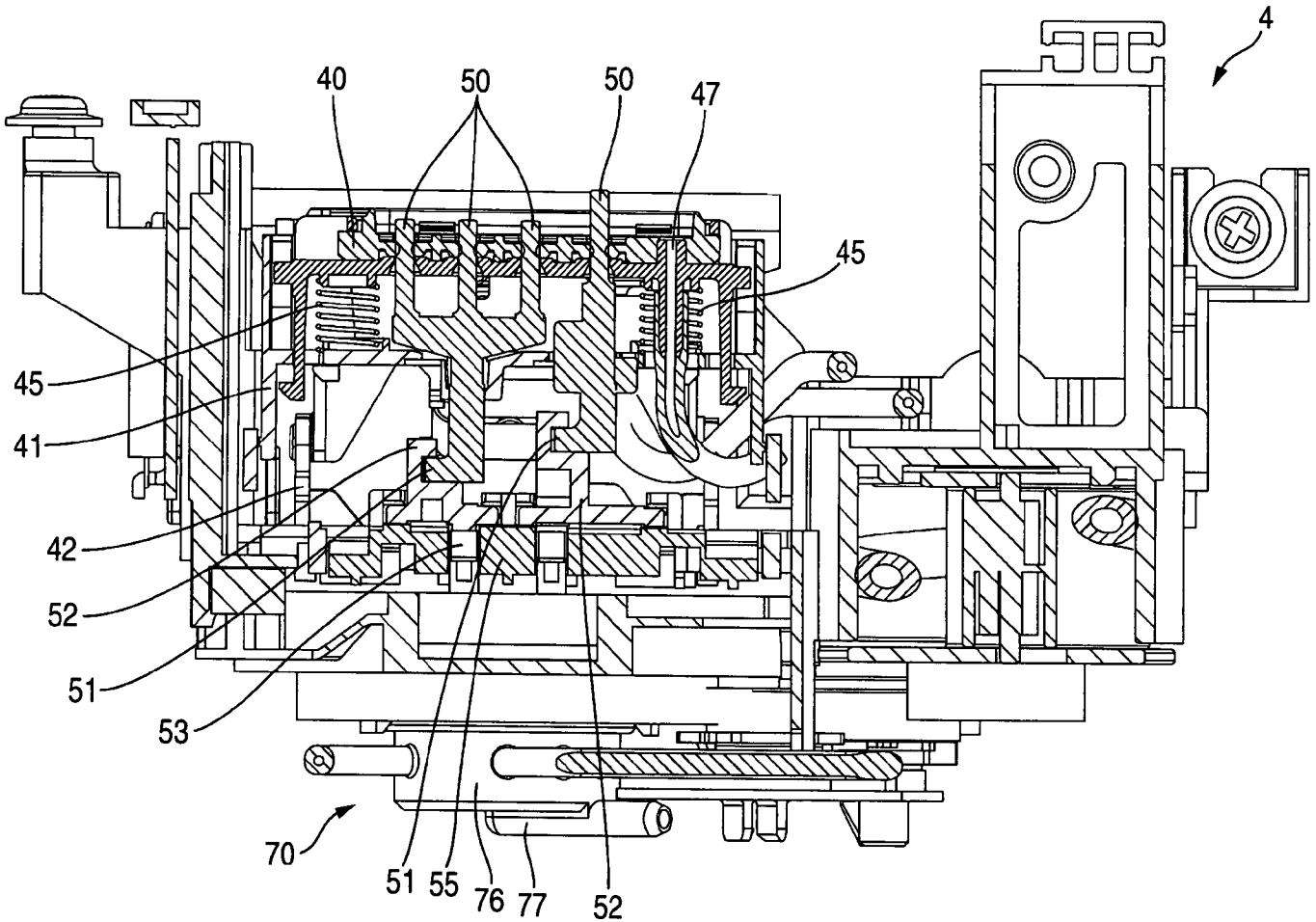
FIG. 10 is a schematic cross-sectional view showing a state where a reclosable member for black ink is at a valve-opening position, and reclosable members for color inks are at the valve-closing position.
Figure 11:
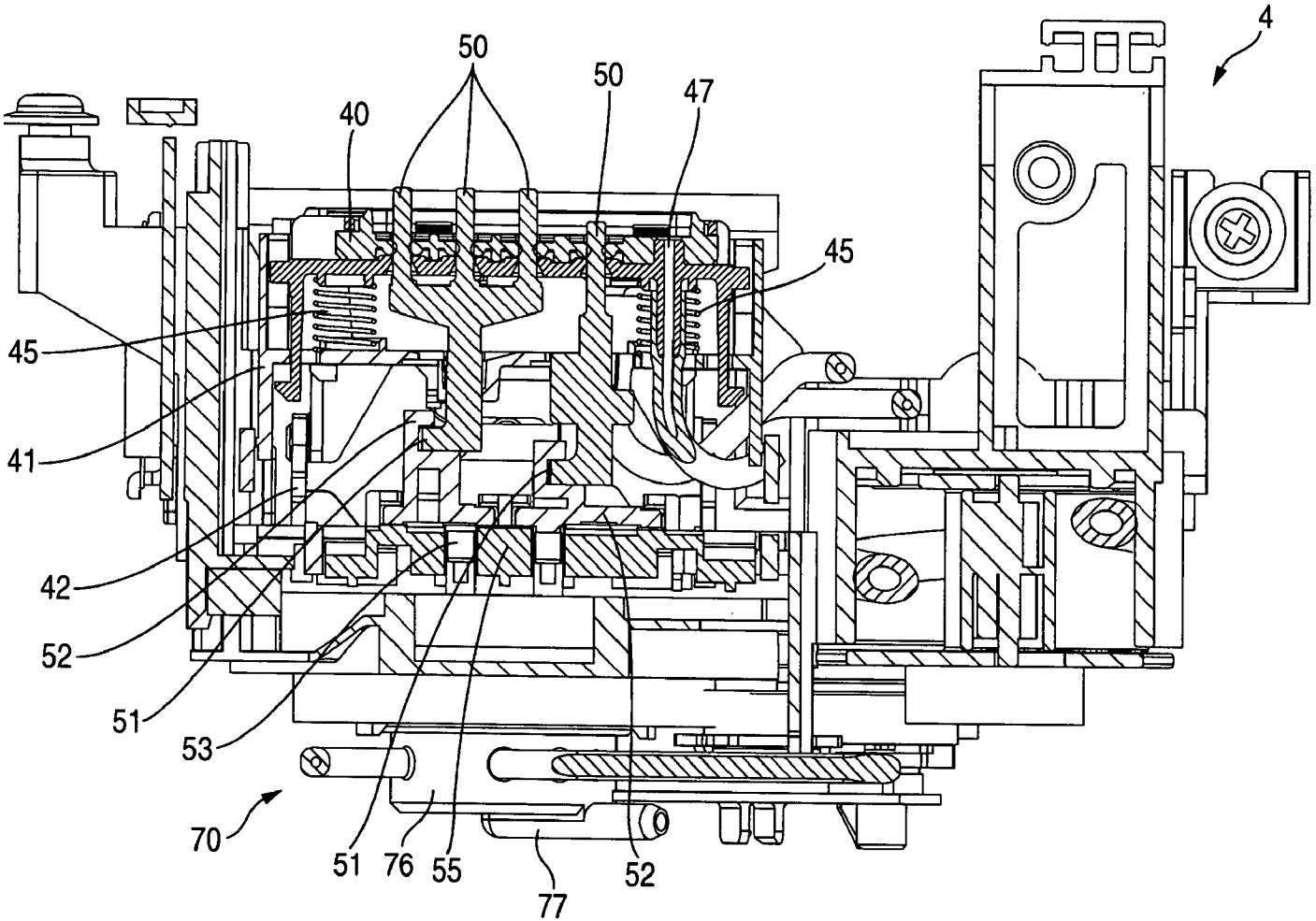
FIG. 11 is a schematic cross-sectional view showing a state where the reclosable member for black ink is at the valve-closing position, and the reclosable members for color inks are at the valve-opening position.
Figure 14:
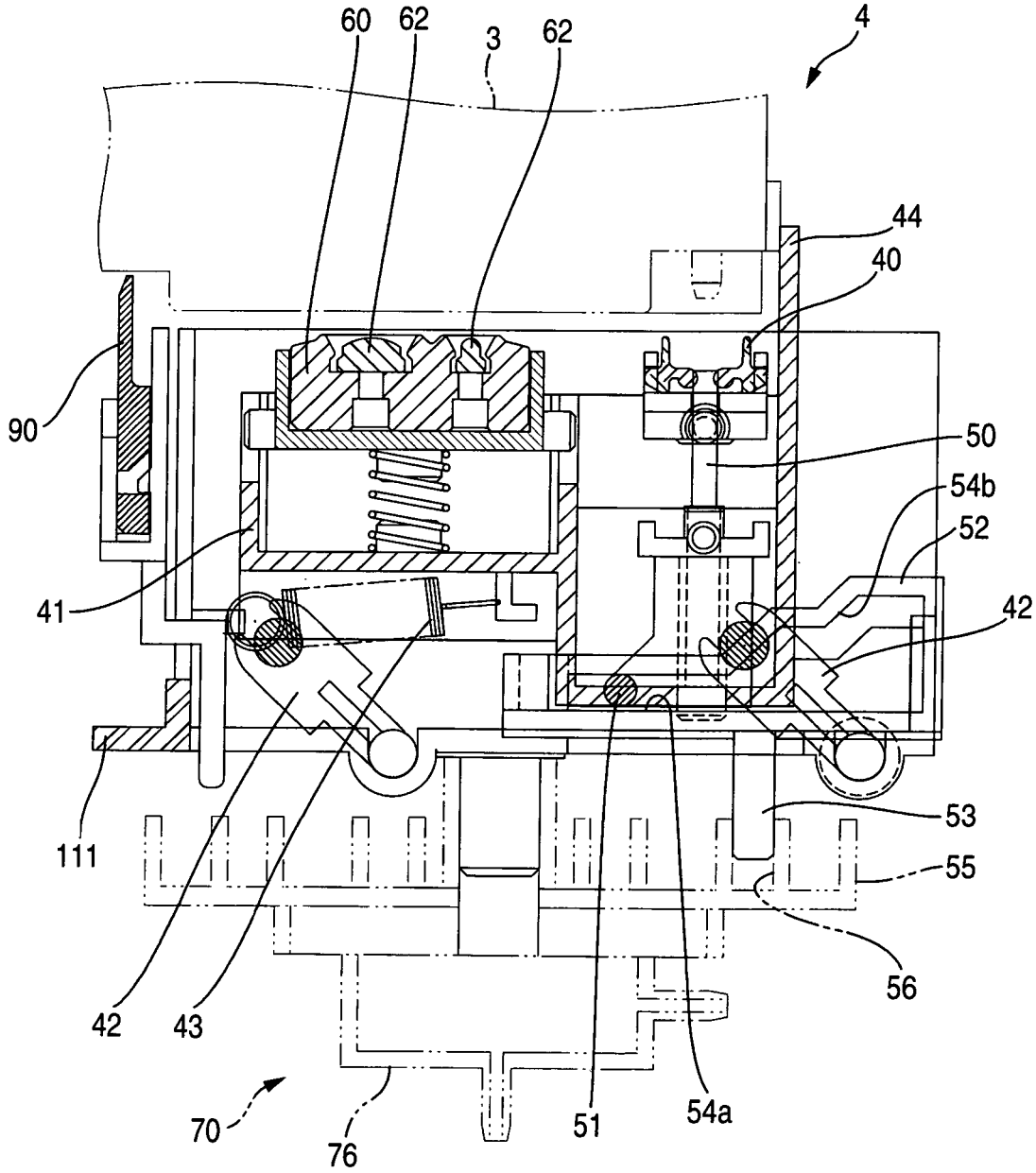
FIG. 14 is a schematic cross-sectional view showing a state where the carriage is at an uncapped suction position.
Figure 16:
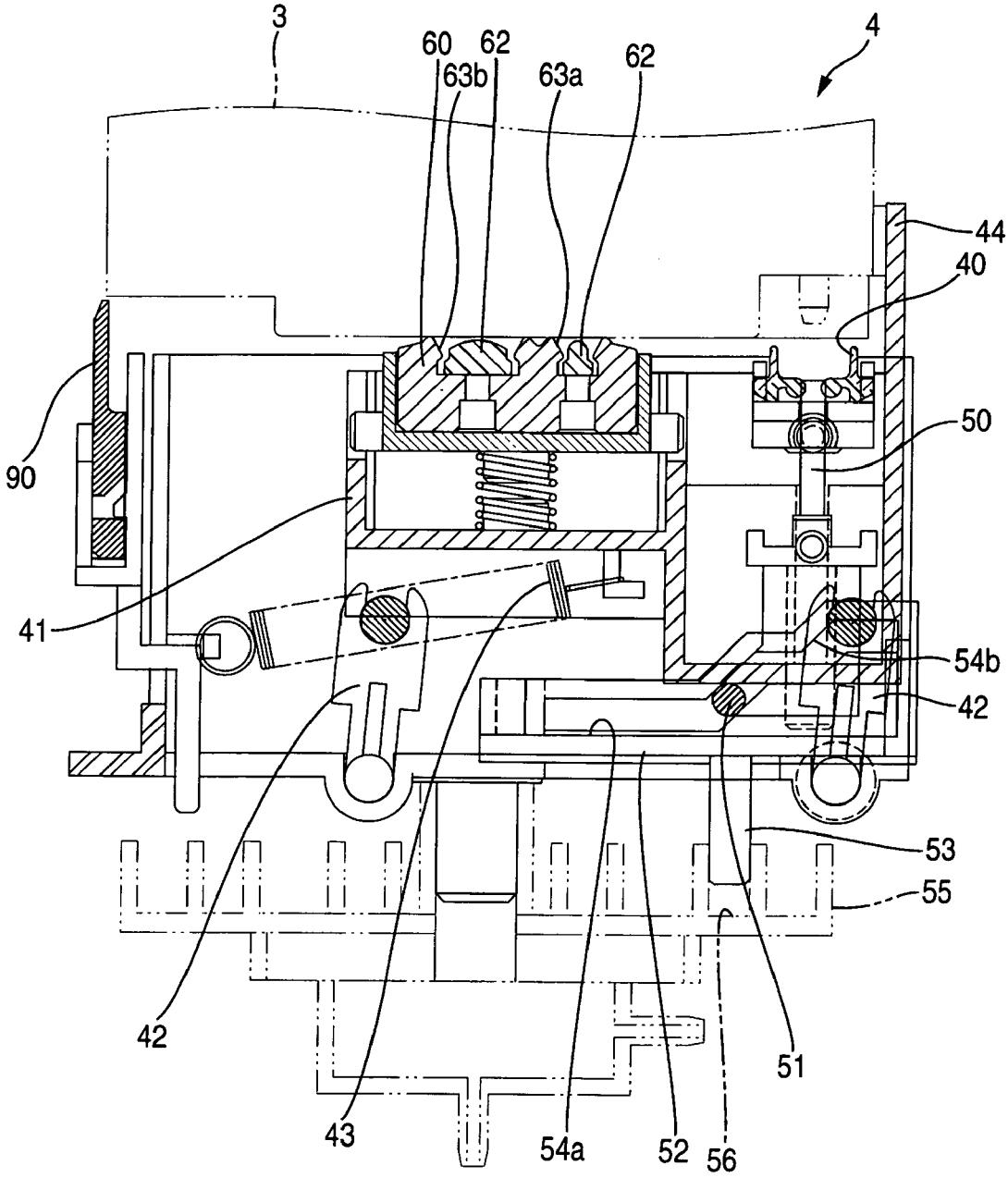
FIG. 16 is a schematic cross-sectional view showing a state where the carriage has further moved to the home position from the state shown in FIG. 15, whereby closeness of the nozzle cap with the carriage has increased.
Figure 17:
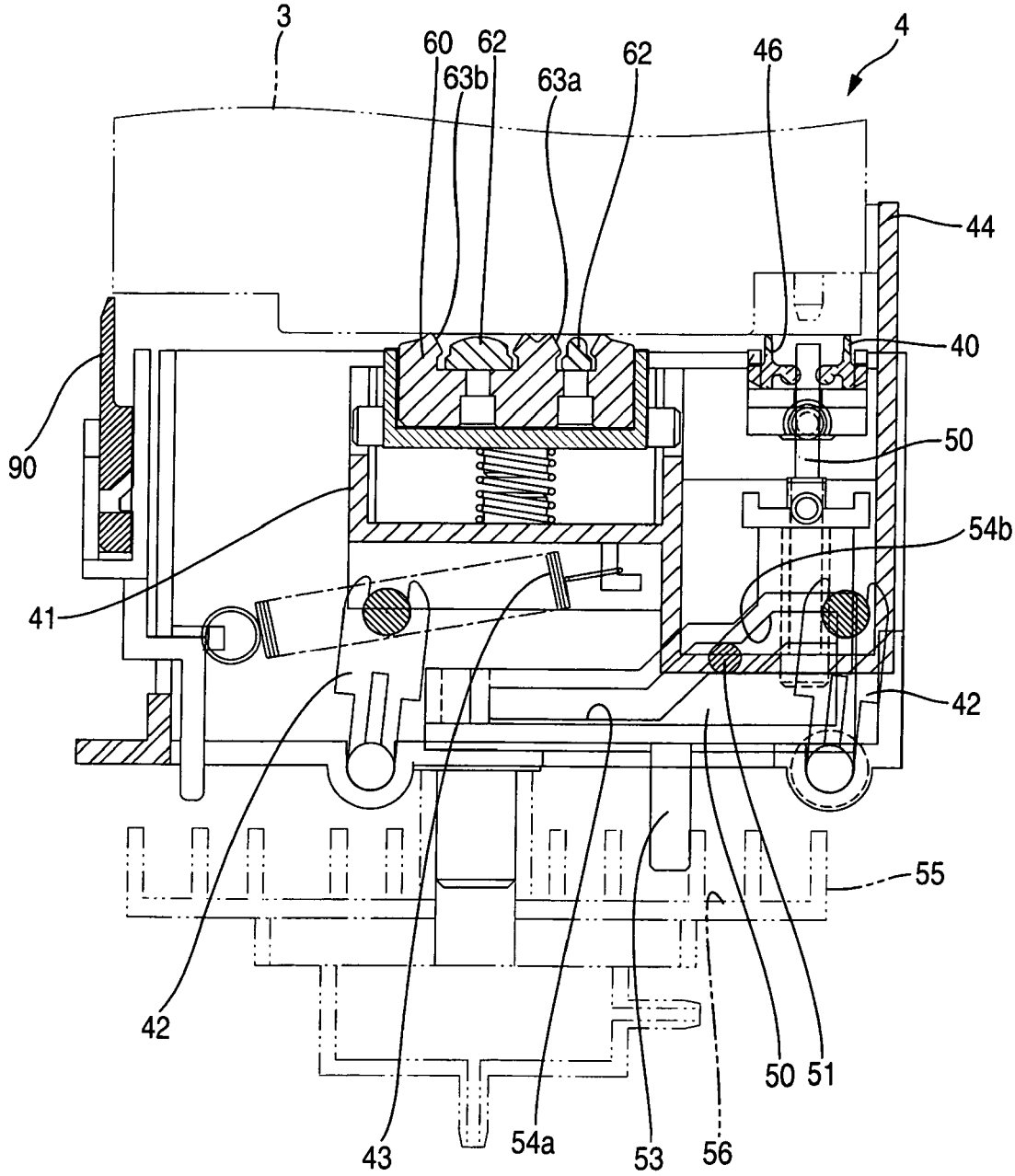
FIG. 17 is a schematic cross-sectional view showing a state here the carriage has moved closer to the home position than to the uncapped suction position, whereby the air-discharge cap has been brought into close contact with the carriage.
Figure 18:
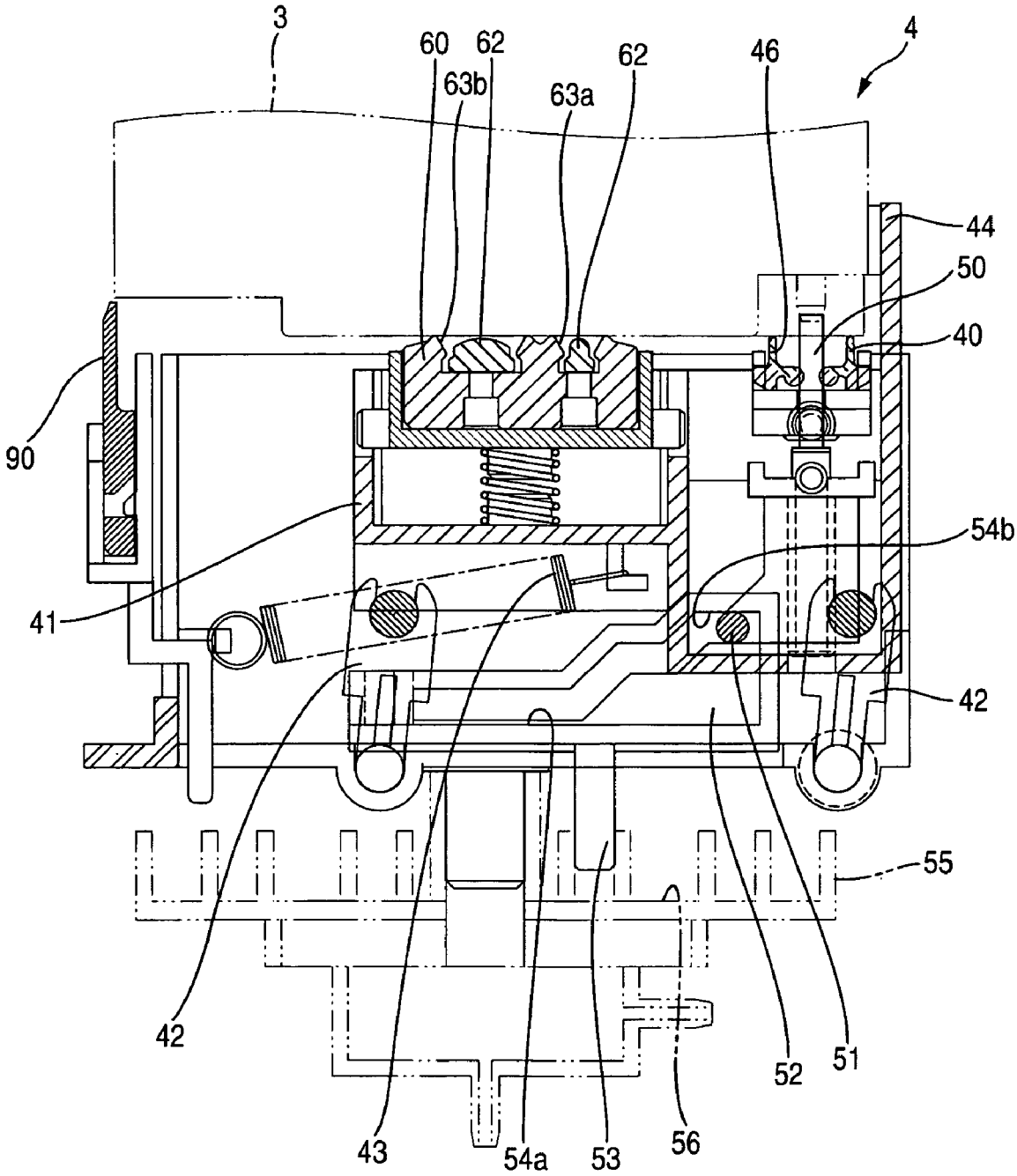
FIG. 18 is a schematic cross-sectional view showing a state where the reclosable member has displaced to the valve-opening position.

A cap lift holder 41 is movably disposed in the maintenance frame 111. As shown in FIGS. 8, 9, and 14 to 18, the cap lift holder 41 is configured so as to be able to horizontally translate along an arc-like path between a receded position and a close-contact position, by means of a coupling mechanism with four joint units, wherein the joint units consist of two pairs of parallel isometric links 42; namely, one of the pairs being disposed on the right side and the other being disposed on the left side. The receded position is set to a low-level position on the left as shown in FIGS. 8 and 14; and the close-contact position is set to a high-level position on the right as shown in FIGS. 9 and 17. A return spring 43 urges the cap lift holder 41 to the receded position. In addition, on a right end edge of the cap lift holder 41, a receiving plate 44 standing upright is formed. During the course of the carriage 3 moving from the recording region 8 to the home position (the maintenance position), the carriage 3 abuts the receiving plate 44 immediately before reaching the home position from the left. Thereafter, until the carriage 3 reaches the home position, the carriage 3 moves the cap lift holder 41 from the receded position to the close-contact position against the tension of the return spring 43 while pushing the receiving plate 44.

The air-discharge cap 40 is supported on a right end of the cap lift holder 41 by way of a push-up spring 45 so as to be relatively movable in the vertical direction. The air-discharge cap 40, which is made of silicon rubber, is rectangular and elongated in the front-and-rear direction, and has a recessed section whose top is open. The air-discharge cap 40 is on standby at a level lower than a bottom face of the carriage 3 when the cap lift holder 41 is at the receded position. During the course of the cap lift holder 41 being pushed by the carriage 3 to thus be displaced upward and to the right along an arc-like path toward the close-contact position, a lip section on an upper end edge of the air-discharge cap 40 is brought into close, airtight contact with the bottom face of the carriage 3 while the degree of closeness is increased by restoration force of the push-up spring 45. As a result of the close contact, an airtight space 46 which is in communication with the four discharge ports 18 is formed from the recessed section of the air-discharge cap 40 and the bottom face of the carriage 3 (see FIGS. 17 and 18). An inlet port 47 which is in communication with the recessed section is open at a rear end of the bottom wall of the air-discharge cap 40. The inlet port 47 is connected to an air-discharge port 78 of switching means 70 by way of a tube.

Reclosable Member 50 of Maintenance Unit 4

Four reclosable members 50—which are of a stick-shape and are aligned in the front-rear direction—pass through the bottom wall of the air-discharge cap 40 in such a manner as to be able to slide vertically while being maintained in the airtight state. Of the four reclosable members 50, a reclosable member 50 for black ink located at the rearmost position (an uppermost position in FIGS. 12 and 13, and a rightmost position in FIGS. 10 and 11) can independently move vertically in relation to the air-discharge cap 40. A cam follower 51 (see FIGS. 14 to 18) protruding laterally is formed at a lower end portion of the reclosable member 50 for black ink. Of the four reclosable members 50, the three reclosable members 50 located frontward are connected with each other below the air-discharge cap 40, and are configured so as to move vertically as a unit. Another cam follower 51 protruding laterally is also formed on a lower end portion of the reclosable members 50 for color inks. The two cam followers 51 are separately engaged with cam guides of two sliders 52 consisting of a front slider and a rear slider. The sliders 52 are driven by the cam 55 so as to reciprocate laterally. The sliders 52 will be described in detail later.

Incidentally, the air-discharge cap 40 moves together with the cap lift holder 41. However, the reclosable member 50 is configured to displace in conjunction with the air-discharge cap 40 in a horizontal direction with respect thereto but to displace relative to the air-discharge cap 40 in a vertical direction. Thus, since the reclosable member 50is allowed to move relatively in a vertical direction, the reclosable member 50 is maintained engaged with the sliders 52 in all cases irrespective of a position of the cap lift holder 41.

Drive Mechanism of Reclosable Member 50

Figure 12:
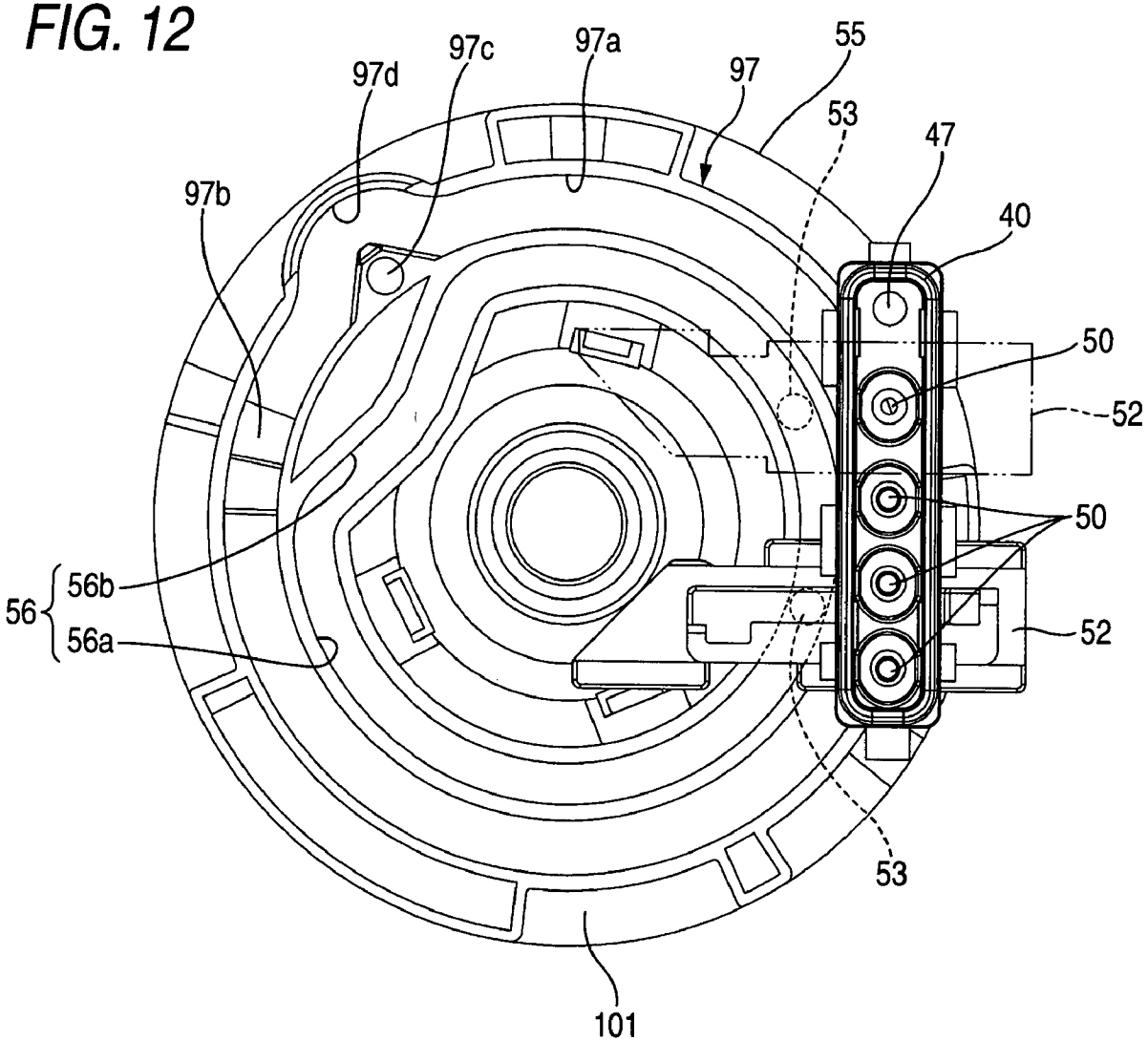
FIG. 12 is a plan view of the cam showing a state where the reclosable members for color inks are at the valve-closing position.
Figure 13:
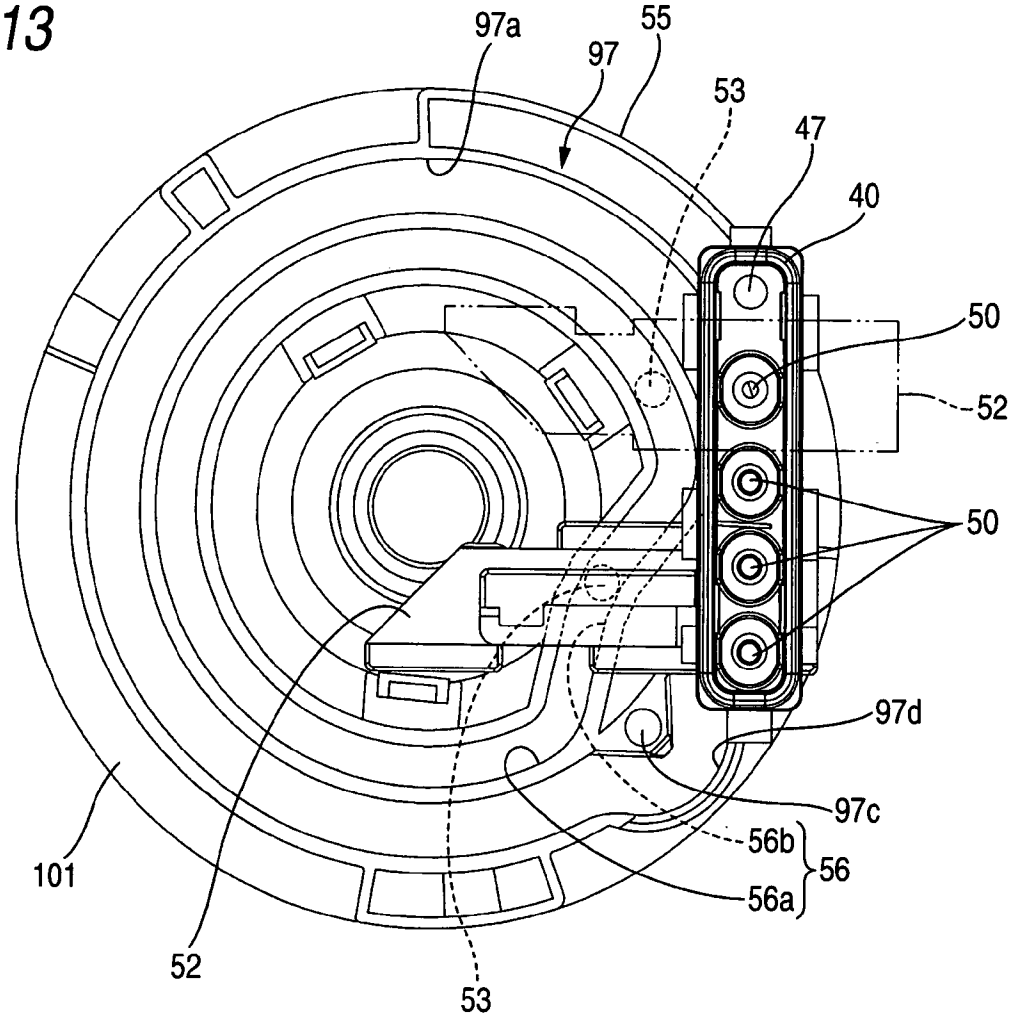
FIG. 13 is a plan view of the cam showing a state where the reclosable members for color inks are at the valve-opening position.

A cam groove 56 is formed on a top face of the cam 55. As shown in FIGS. 12 and 13, the cam groove 56 is constituted of a non-drive region 56*a* and a drive region 56*b*. The non-drive region 56*a* is of an arc-shape and is concentric with the cam 55. The drive region 56*b* is continuous with the non-drive region 56*a*, and curved closer to a radial center than is the non-drive region 56*a*. In addition, the two sliders 52 consisting of the front slider and the rear slider are supported in such a manner that the two sliders 52 can individually move parallel in the lateral direction (i.e., a direction parallel to the moving direction of the carriage 3) above the cam 55. A cam follower 53 protruding downward from each of the sliders 52 is engaged with the cam groove 56 at a position rightward of a center of the cam 55. Under a state where the cam follower 53 is engaged with the non-drive region 56*a*, the sliders 52 are on standby at the rightward position (see FIG. 12). When the cam follower 53 is engaged with the drive region 56*b*, the sliders 52 slide leftward (see FIG. 13). The slider 52 on the rear side (upper side in FIG. 12) is for the purpose of driving the reclosable member 50 for black ink; and the slider 52 on the front side is for the purpose of driving the reclosable member 50 for color inks.

A free guide 54*a* and a cam guide 54*b* for causing the cam follower 51 of the reclosable member 50 to be engaged are formed in each of the sliders 52. As shown in FIGS. 14 to 18, the free guide 54*a* extends laterally (i.e., parallel to the moving direction of the sliders 52) in a straight line, and has a path inclined upward and rightward on the right end thereof. The cam guide 54*b* is continuous with the right end of the free guide 54*a*, and has a slant section climbing rightward.

Under a state where the cap lift holder 41 is at the receded position, regardless of whether the slider 52 is engaged with the non-drive region 56*a* or the drive region 52*b*, the cam follower 51 of the reclosable member 50 maintains an engagement state with the free guide 54*a*, and is disengaged from the cam guide 54*b*. When the carriage 3 moves the cap lift holder 41 to the close-contact position, a state of the slider 52 of the reclosable member 50—having been displaced rightward together with the cap lift holder 41—is shifted from a state of engagement with the free guide 54*a* to a state of engagement with the cam guide 54*b*. At this time, when the cam follower 53 of the slider 52 is engaged with the non-drive region 56*a*, the cam follower 51 of the reclosable member 50 is engaged with a left end (at the same level with the right end of the free guide 54*a*), which is the lowest-level portion of the cam guide 54*b*. Accordingly, the reclosable member 50 is on standby at the valve-closing position of a lowest level. At this valve-closing position, the upper end of the reclosable member 50 is located further downward than the lower end of the valve body 20 of the reclosable valve 19. Accordingly, the reclosable valve 19 is maintained in the valve-closed state.

When, from the above state, the cam follower 51 of the slider 52 shifts to a state of engagement with the drive region 56*b* to thus slide leftward, the cam follower 51 of the reclosable member 50 climbs the slant section while moving rightward along the cam guide 54*b*. Accordingly, the reclosable member 50 rises from the valve-closing position and moves to the valve-opening position. When the reclosable member 50 moves to the valve-opening position, the upper end of the reclosable member 50 abuts the lower end of the valve body 20, thereby pushing up the valve body 20. Consequently, the reclosable valve 19 enters the valve-open state. More specifically, the reclosable member 50 is configured so as to proceed from the valve-closing position to the valve-opening position in a direction substantially perpendicular to the moving direction of the carriage 3 while moving into the corresponding discharge path 17 of the carriage 3, thereby closing the reclosable valve 19.

Nozzle Cap 60 of Maintenance Unit 4

Meanwhile, a nozzle cap 60 is supported on a region leftward of the air-discharge cap 40 of the cap lift holder 41 in such a manner that the nozzle cap 60 can move in the vertical direction 41 by way of a push-up spring 61. The nozzle cap 60 is made of silicone rubber, and is substantially rectangular, elongated in the front-rear direction. The nozzle cap 60 has two recessed sections whose top sides are open and which are disposed on the right and the left, respectively. A spacer 62 is disposed in each of the recessed sections, wherein the spacer 62 has a vault cross-sectional profile with a bulging upper face. The nozzle cap 60 is on standby at a level lower than the bottom face of the carriage 3 when the cap lift holder 41 is at the receded position. During the course of the cap lift holder 41 being pushed by the carriage 3 to thus be displaced upward and rightward in an arc-like path, a lip section on an upper end edge of the nozzle cap 60 is brought into close and airtight contact with the bottom face of the carriage 3 while the degree of closeness is increased by means of urging by the push-up spring 61. As a result of the close contact, two enclosed spaces 63 are configured simultaneously from top faces of the spacers 62 of the nozzle cap 60 and the bottom face of the carriage 3 (see FIG. 16). One of the enclosed spaces 63 is on the right and the other is on the left, and each is in communication with the nozzles of the corresponding recording head 10. The narrow enclosed space 63*a* for black ink on the right side corresponds to the nozzles for black ink; and the wide enclosed space 63*b* for color inks on the left side corresponds to the nozzles for three color inks.

An inlet port 64 is open in a bottom wall of each of the recessed sections of the nozzle cap 60 so as to be located on the rear end (one end in the longitudinal direction) of the bottom wall. The inlet port 64 in the narrow recessed section for black ink is connected to a black ink port 79 (hereinafter, referred to as a "Bk port") of the switching means 70, by way of a tube. The inlet port 64 in the wide recessed section for color inks is connected to a color inks port 80 (hereinafter, referred to as a "Co port") of the switching means 70, by way of a tube. Each of the enclosed spaces 63 is of a form whose vertical gap is the narrowest at a center in the lateral direction (i.e., in the width direction), and is gradually increased to the right and left. Therefore, when a negative pressure is produced within the enclosed space 63 so as to suck ink in the nozzles to the inlet port 64, an airflow (air containing ink) directing from a lateral center to lateral sides (toward sides where flow resistance is low) is generated so as to be substantially uniform in the front-rear direction. The airflow merges at the respective lateral ends in the enclosed space 63 to thus form a large flow directing to the inlet port 64 (rearward), thereby being sucked in the inlet port 64.

Accordingly, even when the inlet port 64 is disposed at a rear end of the enclosed space 63 which is elongated in the front-rear direction, the airflow can be rendered substantially uniform over the entire region, to thus effect ink purging with respect to all the nozzles uniformly.

Switching Means 70 of Maintenance Unit 4

The switching means 70 has a function of switching the airtight space 46 formed by the air-discharge cap 40 between a state of being in communication with the pump 38 and a state of being shut-off from the pump 38; and a function of switching the enclosed space 63 formed by the nozzle cap 60 between a state of being in communication with the pump 38 and a state of being shut-off from the pump 38. The switching means 70 comprises an attachment section 71 formed on the bottom face of the cam 55, a switching member 73, and a cover 76.

As shown in FIG. 5, the attachment section 71 is circular and concentric with the cam 55 and the driven gear 36. Positioning protrusions 72 are formed on the outer periphery of the attachment section 71. The switching member 73, which is made of rubber, is of a disk shape. A switching channel 74 is formed on the outer surface of the switching member 73. The switching channel 74 comprises four branched grooves 74*a* extending radially from a center of the bottom face of the switching member 73, and communication grooves 74*b* formed so as to be continuous from the outer peripheral ends of the respective branched grooves 74*a*. The switching member 73 is fit in the attachment section 71 while causing a positioning groove 75 on a top face of the switching member 73 to fit in the positioning section 72 (see FIGS. 8 and 9). Accordingly, the switching member 73 is attached to the cam 55 and the driven gear 36 so as to rotate concentrically and integrally therewith.

The cover 76 is made of a synthetic resin, and assumes the form of a closed-end cylinder. An inlet port 77 is formed at a center of a bottom wall of the cover 76. The inlet port 77 is connected to the pump 38 by way of a tube. Five ports 78 to 82 are formed on the circular circumference wall of the cover 76 with predetermined angular intervals therebetween in the circumferential direction. The first port of the five ports is a discharge port 78 communicating with the airtight space 46 formed by the discharge cap 40. The second port is the Bk port 79 (the port for black ink) communicating with the enclosed space 63 for black ink formed from the nozzle cap 60. The third port is the Co port 80 (the port for color inks) communicating with the enclosed space 63 for color inks formed by the nozzle cap 60. The remaining two ports are air ports 81, 82 open to the outside air.

The cover 76 is attached to the cam 55 by means of three retaining claws 83 formed on the bottom face of the cam 55. More specifically, a flange 84 is formed on the outer periphery of the cover 76 continuously around the entire periphery. The three retaining claws 83 are disposed on a circumference concentric with the cam 55 with predetermined angular intervals therebetween, thereby enabling elastic deformation in the radial direction. When the cover 76 is assembled to the bottom face of the cam 55, the three retaining claws 83 are hooked on the bottom face of the flange 84 from the outer periphery. As a result, the cover 76 is supported in such a manner that the cover 76 can rotate in relation to the cam 55 and the switching member 73 and that the same is restricted in relative displacement in the vertical direction (i.e., in the direction along the rotational axis of the cam 55). In a state where the cover 76 is assembled to the cam 55, the switching member 73 is stored inside the cover 76, and a lip section on the outer periphery of the switching member 73 is in close contact with the inner periphery of the cover 76. When relative rotation occurs between the cover 76 and the switching member 73, a sliding resistance (frictional resistance) develops between the lip section on the outer periphery of the switching member 73 and the inner periphery of the cover 76.

An arm section 85 extending in the radial direction is formed on the outer periphery of the cover 76 integrally therewith. The extended end of the arm section 85 fits on the shaft 33 of the sun gear 32 so as to allow relative rotation. The fitting of the arm section 85 on the shaft 33 maintains the cover 76 in a state where relative rotation of the cover 76 in relation to the maintenance frame 111 is restricted. In addition, the ports 78 to 82 of the cover 76 are also fixedly arranged. Meanwhile, a retaining protrusion 33*a* on the shaft 33 prevents the arm section 85 from slipping off downward. The swivel arm 34 is sandwiched between the arm section 85 and the sun gear 32 located above the arm section 85 in a state such that the swivel arm 34 is allowed to rotate in relation to the shaft 33.

During the course of the switching member 73 rotating within the cover 76, a state where none of the four communication grooves 74*b* are in communication with the ports 78 to 82 is switched to a state where one to three of the four communication grooves 74*b* are in communication with the corresponding ports 78 to 82. In the state where none of the four communication grooves 74*b* corresponds to the ports 78 to 82, all the ports 78 to 82 are shut off from the pump 38. When the communication grooves 74*b* are in communication with the corresponding ports 78 to 82, one of the following states is assumed; namely, a state where one or more of the ports 78 to 82 corresponding to the communication grooves 74*b* are brought into communication with the pump 38 by way of the switching channel 74; and a state where a plurality of the ports 78 to 82 corresponding to the communication grooves 74*b* are brought into communication with one another by way of the switching channel 74 and also with the pump 38. Specific switching modes will be described in detail later.

Wiper 90 of Maintenance Unit 4

A cam groove is formed on the top face of the cam 55. The cam groove, which is disposed substantially concentrically on the outside of the cam groove for the reclosable member 50, comprises an arc section, a protuberance section, a release section, and a recessed relief section. The arc section is concentric with the cam 55. The protuberance section is formed on a circumference having substantially the same diameter as the arc section; that is, is formed at a position on the arc section. The release section is disposed on a circumference having substantially the same diameter as the arc section. The recessed relief section is disposed so as to correspond to the release section at a position located radially outside of the release section.

The wiper 90 is for wiping ink adhering to the nozzle face of the recording head 10. The wiper 90 is disposed on the maintenance frame 111 so as to be located at a position leftward of the cap lift holder 41; that is, at a position along the moving path of the carriage 3 between the home position (the maintenance position) and the recording region 8. The wiper 90 is, on the whole, of a plate-like shape and oriented substantially perpendicular to the moving direction of the carriage 3, and moves, at a position higher than the cam 55, between the receded position (see FIGS. 21A and 21B) for receding below the moving path of the carriage 3 and recedes from the recording head 10, and the wiping position (see FIGS. 19A and 19B) for advancing onto the moving path of the carriage 3.

The wiper 90 is disposed between a restriction plate 91 located on the left and a tabular stopper 92 located on the right with predetermined clearances therebetween. By virtue of the above configuration, the wiper 90 is guided so as to be able to ascend and descend without being laterally displaced to a large extent. A latching section 93 is formed on the restriction plate 91 located on the left, and a latch protrusion 94 is formed on the left side face of the wiper 90. The latch protrusion 94 engages with the latching section 93 from above, thereby holding the wiper 90 at the wiping position. In addition, a spring 95 for urging the wiper 90 downward and leftward is formed between a position which is lower than the restriction plate 91 for the wiper 90 and the maintenance frame 111. Furthermore, a cam follower 96 protruding downward is formed on the wiper 90. The cam follower 96 is engaged with a cam groove 97 at a position leftward of the center of the cam 55.

The cam groove 97, which is concentric with the cam 55, comprises an arc section 97*a*, a protuberance section 97*b*, and release section 97*c*. The arc section 97*a* can hold the wiper 90 at the receded position. The protuberance section 97*b* is disposed on a circumference whose diameter is substantially identical with that of the arc section 97*a*, and interferes with the wiper 90 at the receded position, thereby pushing the wiper 90 to the wiping position. The release section 97*c* is disposed on a circumference whose diameter is identical with that of the arc section 97*a*, and interferes, in the radial direction, with the cam follower 96 of the wiper 90 at the wiping position.

In a state where the cam follower 96 is coupled with the arc section 97*a*, the restoration force of the spring 95 urges the cam follower 96 to abut the top face of the arc section 97*a*. At this time, the wiper 90 is held at the receded position. Thereafter, when the protuberance section 97*b* approaches the cam follower 96, the cam follower climbs on the protuberance section 97*b* before reaching the release section 97*c*, as shown in FIG. 19A, whereby the wiper 90 rises to the wiping position. During the above operation, the wiper 90 is in a state where the spring 95 pulls the wiper 90 obliquely leftward to thus press the wiper 90 onto the restriction plate 91. Accordingly, when the wiper 90 reaches the wiping position, the latch protrusion 94 is hooked by the latching section 93, and this hooking action holds the wiper 90 at the wiping position.

Figure 19B:
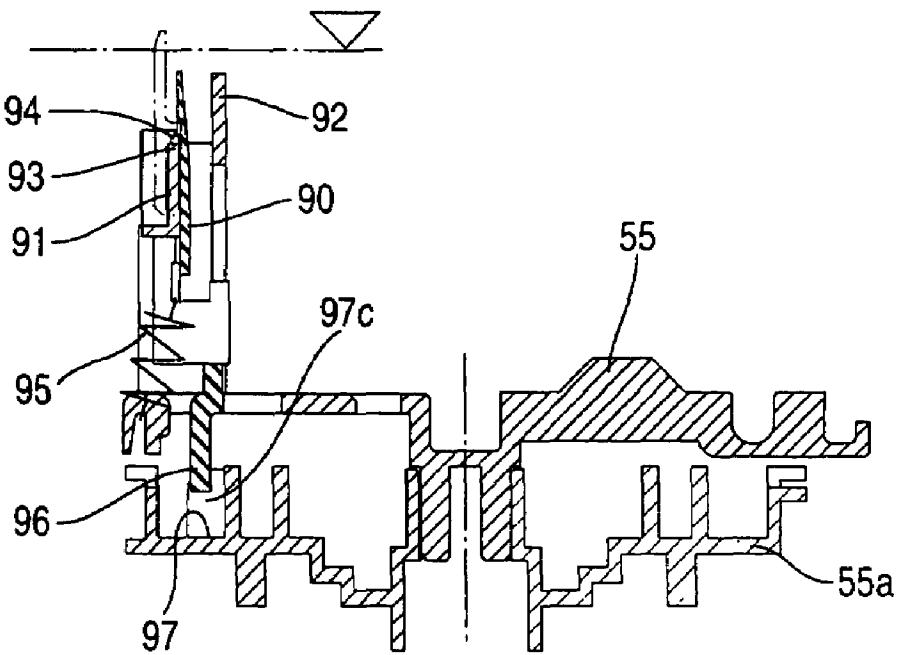
FIG. 19B is a schematic cross-sectional view showing a state that the wiper is held at the wiping position.
Figure 19A:
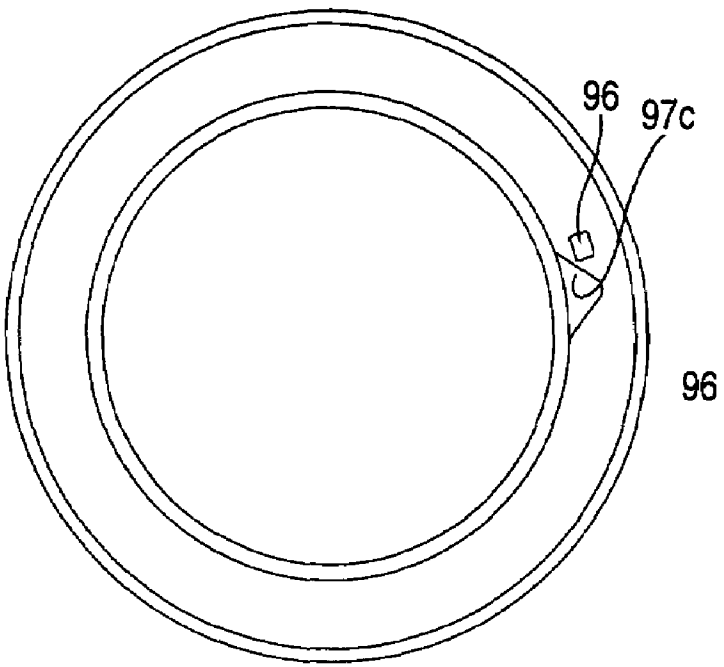
FIG. 19A is a schematic plan view showing a positional relationship between a cam follower of the wiper and a release section of the cam when the wiper is held at the wiping position.

As shown in FIG. 19B, the wiper 90 at the wiping position is pulled downward and leftward by the spring 95 in such a state that: a wiping section on the upper end thereof protrudes higher than the restriction plate 91; the wiping section abuts the restriction plate 91 from the right; and the cam follower 96 abuts an outer peripheral surface of the arc section 97*a* from the right. Therefore, even when the carriage 3 interferes with the upper end section of the wiper 90 from the right (i.e., during the course of the carriage 3 moving from the home position (the maintenance position) to the recording region 8), the wiper 90 is pressed onto the restriction plate 91, thereby maintaining the state where the latch protrusion 94 is hooked by the latching section 93. At this time, the wiper 90 rubs over the nozzle face of the recording head 10, thereby removing ink adhering to the nozzle face.

On the other hand, when the carriage 3 interferes with the upper end section of the wiper 90 from the left, the wiper 90 changes its attitude so as to tilt rightward, thereby releasing the latch protrusion 94 from the latching section 93. Accordingly, the restoration force of the spring 95 lowers the wiper 90 from the wiping position to the receded position.

Figure 20B:
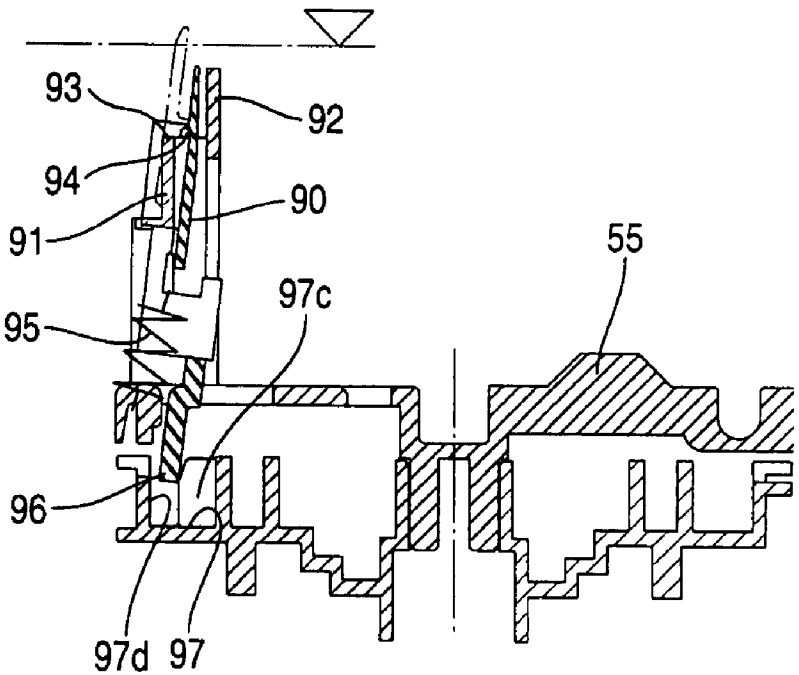
FIG. 20B is a schematic cross-sectional view showing a state where the wiper at the wiping position has been released from the latching section.
Figure 20A:
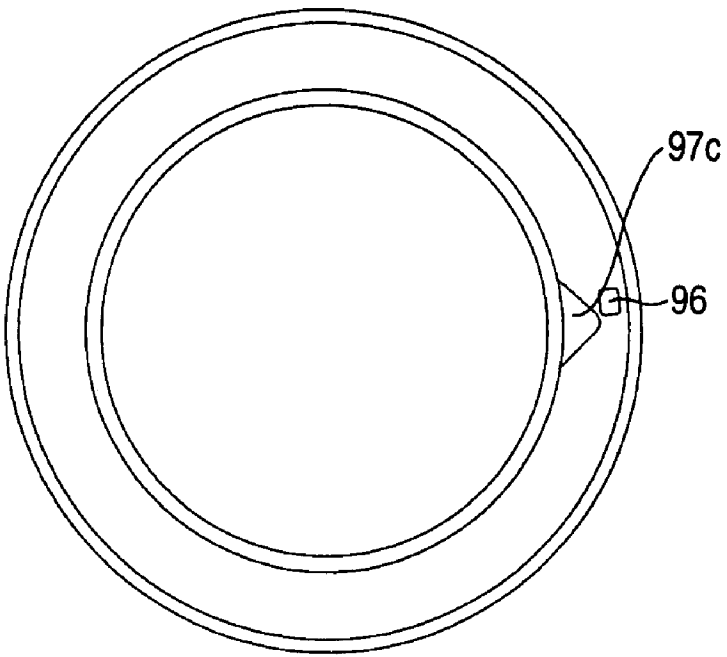
FIG. 20A is a schematic plan view showing a positional relationship between the cam follower of the wiper and the release section of the cam when the wiper at the wiping position has been released from a latching section.
Figure 21A:
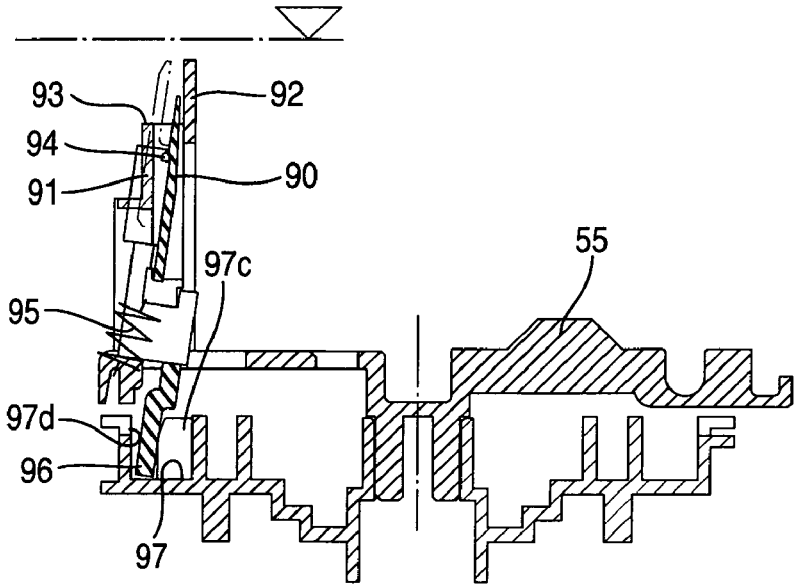
FIG. 21A is a schematic cross-sectional view showing a process whereby the wiper displaces from the wiping position to the receded position.
Figure 21B:
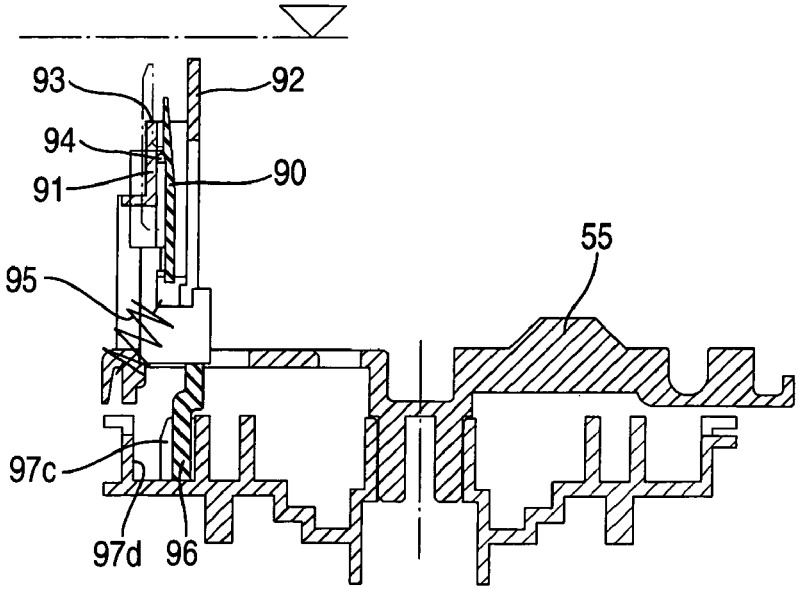
FIG. 21B is a schematic cross-sectional view showing a state where the wiper has displaced from the wiping position to the receded position.

In addition, the wiper 90 at the wiping position is also lowered to the receded position by the release section 97*c* of the cam 55. More specifically, as shown in FIGS. 20A and 20B, when a tapered face of the release section 97*c* abuts a lower end section of the cam follower 96 in accordance with rotation of the cam 55, the lower end section of the cam follower 96 is pushed leftward by the inclination of the tapered face, thereby being displaced to within a recessed relief section 97*d*. In other words, the release section 97*c* interferes with the wiper 90 in the radial direction. As a result, the wiper 90 changes its attitude so as to tilt rightward about a lower end edge of the restriction plate 91 which serves as a pivot, thereby releasing the latch protrusion 94 from the latching section 93 rightward, as shown by FIG. 21A. Hence, the spring 95 urges the wiper 90 to pull downward, thereby bringing the wiper down to the receded position, as shown by FIG. 21B.

Carriage Lock 100 of Maintenance Unit 4

A flange 101 whose bottom face is formed into a cam face 102 is formed on the outer periphery of the cam 55. A region which is partially upwardly recessed; that is, a partially protruding region, is formed on the cam face 102. The region serves as a lock region 102*a* (see FIG. 5). In addition, a portion of the cam face 102 whose height is lower than the lock region 102*a* serves as a lock-release region 102*b*. A carriage lock 100 is supported by the maintenance frame 111 in a state where the carriage lock 100 can move vertically in relation to the maintenance frame 111 and an unillustrated spring urges the carriage lock 100 upward. A cam follower 103 formed on a lower end of the carriage lock 100 abuts the cam face 102 from underneath. Accordingly, most of the carriage lock 100 is located higher than the cam 55. In a state where the cam follower 103 abuts the lock release region 102*b*, the carriage lock 100 is held at a lower, lock-release position. In a state where the cam follower 103 abuts the lock region 102*a*, the carriage lock 100 moves upward, thereby moving onto the moving path of the carriage 3. At this time, when the carriage 3 is located at the home position (the maintenance position), an upper end section of the carriage lock 100 is locked on a front end section on the left side face of the carriage 3. The locking restricts leftward movement; that is, movement to the recording region 8 of the carriage 3.

Control Means for Rotational Position of Cam 55

A detected section 105 is disposed on the flange 101 on the outer periphery of the cam 55 so as to rotate integrally with the cam 55. A leaf switch 106, which is switched ON-OFF by the detected section 105 in accordance with the rotation of the cam 55, is disposed on the maintenance frame 111. When the leaf switch 106 is in the ON or OFF state (a position A (M), N, O, Q, R, S, or K in FIG. 22), counting of the number of revolutions of the motor 24 for driving the cam 55 is started. The stopping position of the cam 55 is accurately controlled on the basis of the count. Meanwhile, in the following descriptions of processes of the maintenance or the like, descriptions of an ON-OFF operation of the leaf switch 106 and control of rotational position of the cam 55 on the basis of the ON-OFF operation will be omitted.

Operations of Cap Lift Holder 41 in Accordance with Moving of Carriage 3

When the carriage 3 moves from the recording position to the home position in a state where restoration force of the return spring 43 holds the cap lift holder 41 at the receded position, as shown in FIG. 14, at a timing where the carriage 3 reaches the uncapped suction position, the carriage 3 abuts the receiving plate 44 of the cap lift holder 41. At this time, both the air-discharge cap 40 and the nozzle cap 60 are located lower than the bottom face of the carriage 3. More specifically, neither the air-discharge cap 40 nor the nozzle cap 60 is in contact with (i.e., both are separated from) the bottom face of the carriage 3.

Figure 15:
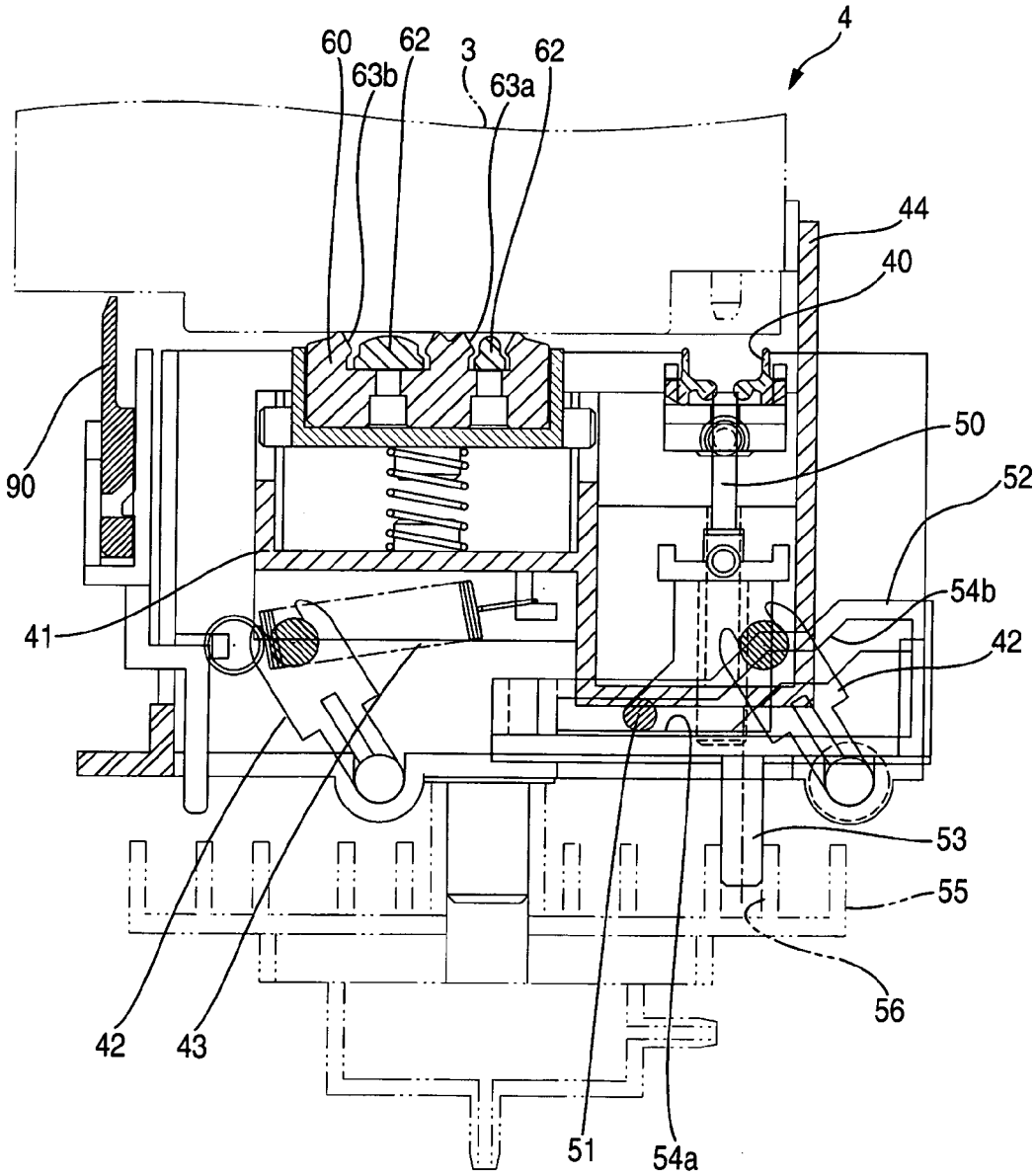
FIG. 15 is a schematic cross-sectional view showing a state where the carriage has moved closer to the home position than to the uncapped suction position, whereby a nozzle cap has been brought into close contact with the carriage.

When the carriage 3 moves to the home position from the above state, as shown in FIG. 15, the cap lift holder 41 moves upward and rightward in an arc-like path. Accordingly, the nozzle cap 60 is brought into contact with the nozzle face of the recording head 10 from below. When the carriage 3 further moves rightward, as shown in FIG. 16, the spring 61, which is located between the cap lift holder 41 moving upward and the nozzle cap 60 in contact with the bottom face of the carriage 3, is elastically compressed. Accordingly, the elastic restoration force of the spring 61 strongly presses the nozzle cap 60 onto the recording head 10, whereby the enclosed spaces 63, which are securely sealed airtight, are formed between the nozzle face and the nozzle cap 60.

When the carriage 3 moves further rightward from the above state, as shown in FIG. 17, the air-discharge cap 40 comes into close contact with the bottom face of the carriage 3, and the elasticity of the spring 45 disposed between the air-discharge cap 40 and the cap lift holder 41 strongly presses the air-discharge cap 40 onto the bottom face of the carriage 3. As a result, the airtight space 46, which is securely sealed airtight, is formed between the bottom face of the carriage 3 and the air-discharge cap 40.

Air-Discharge Process and Uncapped Suction Process in Maintenance

At an initial time in a process of discharging bubbles stored in the bubble reservoirs 12, the carriage 3 is at the home position, and is locked at the home position by means of locking by the carriage lock 100. In a state where the carriage 3 is locked at the home position, the air-discharge cap 40 is in close contact with the bottom face of the carriage 3, thereby forming the airtight space 46. In addition, the cam 55 and the switching member 73 are located at the position A (M) in FIG. 22. At this time, the airtight space 46 is in a shut-off state and in communication with neither the outside air nor the pump 38. Furthermore, the enclosed space 63 for black ink and the same for color inks are both open to the outside air by way of the switching channel 74, and are in communication with the pump 38.

Figure 22:
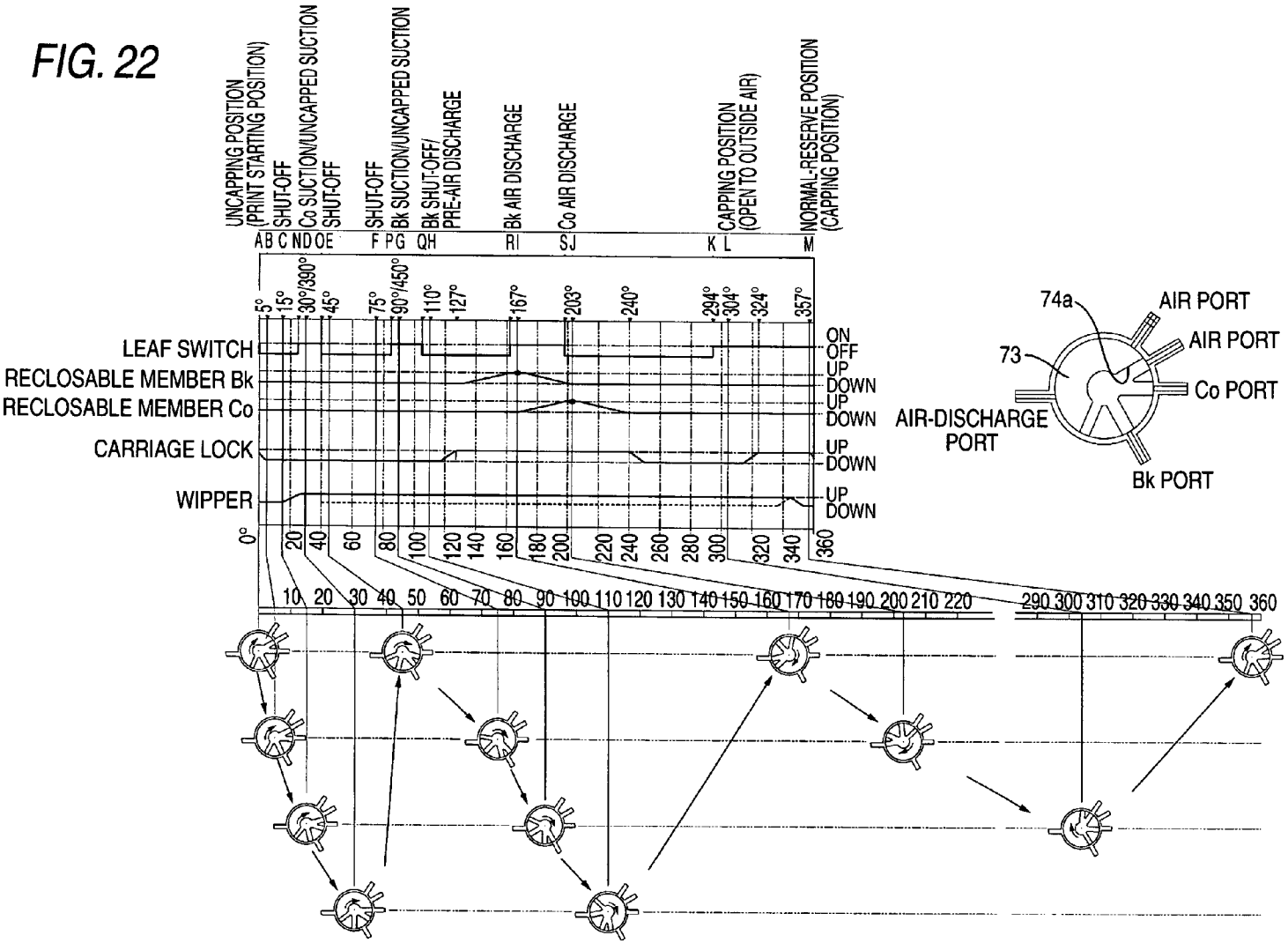
FIG. 22 is a chart diagram showing positions of the cam and a switching member, a displacement state of the reclosable member, a displacement state of the carriage lock, and a displacement state of the wiper.

From the above state, the cam 55 and the switching member 73 rotate to the position H in FIG. 22, and stop, thereby entering a state where the airtight space 46 is in communication only with the pump 38 by way of the switching member 73. At this time, both the enclosed space 63 for black ink and the same for color inks enter a shut-off state of being in communication with neither the outside air nor the pump 38. In this state, the planetary gear 35 revolves to drive the pump 38, and air in the airtight space 46 is discharged. As a result, a negative pressure is produced in the airtight space 46.

After the pre-air-discharge is performed as described above, the cam 55 and the switching member 73 move to the position I. During the course of the movement, the slider 52 for black ink is engaged with the cam 55 to thus be moved leftward, and the reclosable member 50 for black ink is pushed up from the valve-closing position to the valve-opening position. As a result of the pushing-up of the reclosable member 50, the reclosable valve 19 disposed on the discharge path 17 for black ink enters a valve-open state. In addition, the airtight space 46 enters a state of being in communication with only the pump 38, and the enclosed space 63 for black ink and the same for color inks enter the shut-off state of being in communication with neither the outside air nor the pump 38. The pump 38 is activated in the state at the position I, and bubbles having been stored in the bubble reservoir 12 for black ink are discharged to the outside air by way of the discharge path 17, the airtight space 46, the switching channel, and the pump 38. During the above air-discharge process, the enclosed space 63 for black ink and the same for color inks are maintained in the shut-off state.

Upon completion of the air-discharge of the bubble reservoir 12 for black ink by means of the pump 38, the cam 55 and the switching member 73 move to the position J. During the course of the movement, the slider 52 for black ink returns rightward, to thus return the reclosable member 50 to the valve-closing position, thereby closing the reclosable valve 19 for black ink. In addition, the slider 52 for color inks moves leftward, and the lower portion of the slider 52 for color inks is pushed up from the valve-closing position to the valve-opening position, thereby opening the three reclosable valves 19 for color inks disposed on the discharge paths 17. As in the case of the position I, the airtight space 46 enters a state of being in communication with only the pump 38, and the enclosed space 63 for black ink and the same for color inks enter the shut-off state of being in communication with neither the outside air nor the pump 38. The pump 38 is activated in the state at the position J, and bubbles having been stored in the bubble reservoirs 12 for color inks are discharged to the outside air by way of the discharge paths 17, the airtight space 46, the switching channel, and the pump 38. Also during the above air-discharge process, the enclosed space 63 for black ink and the same for color inks are maintained in the shut-off state. Thereafter, the cam 55 and the switching member 73 move to the position A. During the course of the movement, the slider 52 for color inks having been in the valve-open state returns rightward, to thus return the reclosable member 50 to the valve-closing position, thereby closing the reclosable valve 19 for color inks. This completes the process of discharging bubbles in the bubble reservoirs 12. Meanwhile, during the air-discharge process, the carriage 3 is maintained at the home position.

Thereafter, the cam 55 and the switching member 73 rotate to the position B, and the carriage lock 100 descends, whereby the carriage 3 is released from the moving-restricted state (locked state). Also at the position B, the communication state and shut-off state of the airtight space 46 and the enclosed spaces 63 are identical with those at the position A. When the locking by the carriage lock 100 is released, the carriage 3 moves from the home position to the uncapped suction position, whereby the air-discharge cap 40 and the nozzle cap 60 are separated from the bottom face of the carriage 3. Subsequently, the cam 55 and the switching member 73 rotate to the position G, thereby entering a state where the recessed section of the nozzle cap 60 for black ink is in communication with only with the pump 38, and the recessed section of the air-discharge cap 40 and the same of the nozzle cap 60 for color inks are shut off from the pump 38. During the course of the rotation to the position G, the wiper 90 rises from the receded position to the wiping position, and is held at the wiping position by means of being hooked by the latching section 93. At this time, the carriage 3 is located rightward (at the home position) of the wiper 90.

From the above state, the carriage 3 moves leftward. During the course of the movement, the nozzle face on the bottom face of the carriage 3 slidingly contacts the upper end edge of the wiper 90, whereby ink adhering to the nozzle face is scraped off by the wiper 90. When the carriage 3 has passed through the wiper 90 to thus complete the wiping, the carriage 3 temporarily stops at the wiping-termination position. Thereafter, the carriage 3 returns to the uncapped suction position (the home position). At this time, the carriage 3 abuts the upper end section of the wiper 90 from the left, thereby dropping the wiper 90 from the wiping position to the receded position. After the wiper 90 has been dropped, the carriage 3 stops at the uncapped suction position.

Thereafter, the cam 55 and the switching member 73 move to the position H. At this time, the carriage 3 is at the uncapped suction position, and the air-discharge cap 40 is not in contact with the carriage 3. Accordingly, the airtight space 46 is not formed, and the recessed section of the air-discharge cap 40 enters a state of being in communication with the pump 38. When the pump 38 is activated, the uncapped suction is performed. Accordingly, in the air-discharge process, ink having been sucked in the air-discharge cap 40 together with bubbles (air) in the bubble reservoir 12 is sucked to the pump 38, thereby being discharged. This completes the uncapped suction process.

Thereafter, the cam 55 and the switching member 73 move to the position L. As a result, both the recessed section of the nozzle cap 60 for black ink and the same for color inks enter a state of being open to the outside air and in communication with the pump 38. In addition, the recessed section of the air-discharge cap 40 enters a state of not being in communication with the pump 38. In the above state, the carriage 3 returns from the uncapped suction position to the home position. As a result, the air-discharge cap 40 comes into close contact with the carriage 3, to thus form the airtight space 46 (which is shut off from the outside air), and the nozzle cap 60 comes into close contact with the carriage 3, to thus form the enclosed spaces 63. Thereafter, the cam 55 and the switching member 73 return to the position A (M). This completes the air-discharge process and the uncapped suction process.

Ink-Purging Process in Maintenance

At an initial time of the ink purging process for sucking and discharging ink clogging the nozzles of the recording head 10 and bubbles contained in the ink, the carriage 3 is locked at the home position, thereby forming the airtight space 46 and the enclosed spaces 63. In addition, the cam 55 and the switching member 73 are located at the position A in FIG. 22; and the enclosed space 63 for black ink and the same for color inks are both open to the outside air by way of the switching member 73, and in communication with the pump 38. Furthermore, the airtight space 46 enters a shut-off state of being in communication with neither the outside air nor the pump 38.

From the above state, the cam 55 and the switching member 73 rotate to the position F. As a result, both the enclosed space 63 for black ink and the same for color inks are shut off from the outside air and enter a state of not being in communication with the pump 38. The airtight space 46 also enters a state of being shut off from both the outside air and the pump 38. In the above state, the pump 38 is activated, whereby a negative pressure is generated in the pump 38 and in the switching channel 74 (i.e., the pressure within the pump 38 and the switching channel 74 is lower than the atmospheric pressure).

Thereafter, the cam 55 and the switching member 73 rotate to the position G. As a result, the enclosed space for black ink is brought into communication with the pump 38 by way of the switching member 73, whereby black ink having been stored in the enclosed space 63 for black ink (within the nozzle cap 60) is instantly sucked to the pump 38. Meanwhile, at this time, the airtight space 46 and the enclosed space 63 for color inks are in a state of being shut off from both the pump 38 and the outside air.

Upon completion of the ink purging in the enclosed space 63 for black ink, the cam 55 and the switching member 73 rotate to the position H, thereby entering a state where only the airtight space 46 is in communication with the pump 38 and neither the enclosed space 63 for black ink nor the enclosed space 63 for color inks is in communication with the pump 38, and the enclosed spaces 63 are shut off from the outside air.

Thereafter, the carriage 3 moves from the home position to the uncapped suction position temporarily, and further moves to the recording region 8. At this time, during the course of the cam 55 and the switching member 73 rotating from the position A to the position F as described above, the wiper 90 at the receded position rises, to thus be on standby in a state of being locked at the wiping position. Therefore, during the course of movement of the carriage 3, the nozzle face of the recording head 10 contacts the wiper 90, whereby ink adhering to the nozzle face is wiped off and removed. In addition, after the carriage 3 passes the wiper 90, flushing is performed.

Thereafter, the carriage 3 returns to the uncapped suction position. However, during the course of the return, the carriage 3 abuts the wiper 90, thereby dropping the wiper 90 from the wiping position to the receded position. In addition, in a state where the carriage 3 has returned to the uncapped suction position, the air-discharge cap 40 and the nozzle cap 60 remain separated from the bottom face of the carriage 3. Accordingly, the airtight space 46 and the enclosed spaces 63 are not formed.

Thereafter, the cam 55 and the switching member 73 rotate from the position H to the position L in FIG. 22, thereby entering a state where only the recessed section of the nozzle cap for black ink is in communication with the pump 38. In this state, the pump 38 is activated, and residual black ink in the enclosed space 63 for black ink is sucked and removed to the pump 38.

Thereafter, the cam 55 and the switching member 73 rotate to the position L, thereby entering a state where the enclosed space 63 for black ink and the same for color inks are open to the outside air, and in communication with the pump 38. Meanwhile, the recessed section of the air-discharge cap 40 and the pump 38 are not in communication with one another. In this state, the pump 38 is activated to perform the uncapped suctioning again. As a result, residual ink in the channels among the switching channels 74 which are in communication with the air ports is sucked and removed to the pump 38.

Thereafter, the carriage 3 at the uncapped suction position returns to the home position, thereby forming the airtight space 46 and the enclosed spaces 63. Next, the cam 55 and the switching member 73 rotate to the position A (M). This completes the black-ink purging process.

Meanwhile, a purging process for color inks is performed in a similar manner. In the purging process for color inks, the positions F, G, and H, which are positions ranging from generation of the negative pressure to the completion of ink suction in the purging process for black ink, are changed to positions C, D, and E, respectively; and the position G, which is the position for uncapped suction after wiping, is changed to the position D.

In addition, in the above process, the negative pressure has been generated before the ink purging so as to suck the ink instantly. However, the ink purging can be performed without generating the negative pressure. In this case, the process of stopping at the position F (in the case of color inks, the position C) where ink is sucked by the pump 38 may be omitted.

Process where Carriage 3 Starts Recording on Recording Medium

When the carriage 3 on which maintenance has been performed moves from the home position where the carriage 3 is on standby to the recording region 8 for performing recording on the recording medium while passing through the uncapped suction position and the wiping-termination position, wiping of the nozzle face is not required, and unnecessary wiping shortens a service life of the nozzle face of the recording head 10.

In this case, before the carriage 3 is moved, the cam at the position A is rotated in advance to a position to be reached after passing by the position J; for instance, a position between the positions L and M. During the course of the cam 55 moving from the position J to the position L, the release section 97*c* of the cam 55 interferes with the wiper 90 locked at the wiping position, to thus drop the wiper 90 to the receded position. In this state, even when the carriage 3 is moved from the home position to the recording region 8, the carriage 3 is prevented from contacting the wiper 90, to thus avoid unnecessary wiping.

ADVANTAGES OF THE EMBODIMENT (1) When bubbles (air) stored in the bubble reservoir 12 are discharged, the air-discharge cap 40 is brought into close contact with the carriage 3 to thus form the airtight space 46; and, simultaneously, the reclosable member 50 brings the reclosable valve 19 into a valve-open state. As a result, the bubble reservoir 12 comes into communication with the airtight space 46, whereby air in the airtight space 46 is sucked by the pump 38 and discharged to the outside air. Accordingly, airflow during the course of the bubble-discharge takes the form of one-way flow from the bubble reservoir 12 to the outside air by way of the airtight space 46 and the suction means. By virtue of the one-way airflow, the outside air cannot intrude in the bubble reservoir 12 or the ink channel, whereby mixing of air into the ink can be prevented without fail.

In addition, unnecessary use of ink can be prevented, thereby enabling cost reduction and a reduction in time required for the discharging as compared with a method wherein a negative pressure is generated from the nozzle side of the recording head 10 to thus suck ink, thereby discharging bubbles having been contained in the ink together with the suction.

(2) The operation of opening the reclosable valve 19 by means of the reclosable member 50 is performed in a state where the air-discharge cap 40 is attached to the carriage 3 to thus form the airtight space 46. Accordingly, the bubble discharge path 17 is shut off from the outside air, thereby preventing intrusion of the outside air into the bubble reservoir 12. By virtue of the above configuration, overflow of the ink from the recording head 10 resulting from an increase in the pressure inside the bubble reservoir 12 can be prevented.

(3) In a case where the pressure inside the bubble reservoir 12 is set to be lower than the atmospheric pressure and where the recording head 10 and the ink tank 5 are set to have a difference in pressure head, if the valve is opened with the state where the airtight space 46 remains at atmospheric pressure, the air inside the airtight space 46 flows into the bubble reservoir 12, to thus increase the pressure inside the bubble reservoir 12. Accordingly, the ink flows backward from the recording head 10 to the ink tank 5. However, in the present embodiment, the reclosable valve 19 is opened in a state where the negative pressure is generated in advance in the airtight space 46. Therefore, the bubble reservoir 12 is maintained at the negative pressure, thereby preventing back-flow of the ink to the ink tank 5.

(4) In addition to the reclosable member 50 assuming a form of a stick passing through the air-discharge cap 40, the air-discharge cap 40 is made of silicone rubber. Accordingly, sliding resistance between the air-discharge cap 40 and the reclosable member 50 can be reduced while the airtight state inside the airtight space 46 is ensured.

(5) When bubbles are discharged in a state where the recording head 10 remains open to the outside air, there arises apprehension that a meniscus may be broken in response to a pressure drop inside the bubble reservoir 12. However, in the embodiment, the bubbles are discharged in a state where the recording head 10 is shut off from the outside air by means of close contact with the nozzle cap 60. Accordingly, breaking of the meniscus can be prevented.

(6) In the embodiment, the recording head 10 is provided in two types constituted of that for black ink and that for color inks. In some inkjet printers including the plurality of recording heads 10 as above, because differences in the number of the nozzles, a diameter of the nozzles, or a clearance between the ink channels, the recording heads 10 have different air-discharge resistance values at a time of discharging bubbles stored in the bubble reservoir 12 from the bubble reservoir 12 to the discharge port 18. In this case, when bubbles are discharged simultaneously from the two types of recording heads 10 having different air-discharge resistances, there arises apprehension that the amount of discharged bubbles may vary between the recording heads 10. However, in the embodiment, bubble-discharging with use of the pump 38 is performed independently for the recording head 10 for black ink and for the same for color inks. Accordingly, the amount of discharged bubbles is prevented from varying between the recording heads 10.

(7) The three recording heads 10 for color inks are identical in number of nozzles, nozzle diameter, diameter of the ink channel, and a clearance between ink channels. Accordingly, the three recording heads 10 have identical air-discharge resistance at the time of discharging bubbles stored in the bubble reservoir 12 from the bubble reservoir 12 to the discharge port 18. Hence, in the embodiment, bubbles are discharged simultaneously from the three recording heads 10 for color inks having identical air-discharge resistance. Consequently, bubbles can be discharged effectively while the amount of discharged bubbles is maintained uniform among the recording heads 10.

(8) The switching member 73, which can switch the airtight space 46 between a state of being in communication with the pump 38 and a state of being shut off from the pump 38, and a cam 55, which causes displacement of the reclosable member 50 between the valve-opening state for opening the reclosable valve 19 and the valve-closing state for closing the reclosable valve 19, are displaced integrally. By virtue of the above configuration, an open-and-close operation of the reclosable valve 19 with use of the reclosable 50 resulting from displacement of the cam 55 and bubble-suction with use of the pump 38 by means of the switching member 73 can performed at an accurate timing. More specifically, since a mechanism for synchronizing the operation of the reclosable member 50 with that of the bubble-suction can be negated, the structure can be simplified.

(9) Furthermore, the switching member 73 can be switched between a state where the enclosed space 63 is in communication with the pump 38 and a state where the enclosed space 63 is shut off from the pump 38. Accordingly, not only the open-and-close operation of the reclosable valve 19 and the bubble-suction operation, but also a suction operation for ink clogging the nozzles can be performed at an accurate timing.

(10) All of the reclosable member 50—which is displaced between the valve-opening position for opening the reclosable valve 19 by means of the cam 55 and the valve-closing position for closing the same—the wiper 90—which is displaced between the position where ink adhering to the nozzles of the recording head 10 can be wiped by means of the cam 55 and the position where the wiper 90 does not contact the nozzles—and the carriage lock 100—for holding the carriage 3 at the home position (i.e., the maintenance position) for discharging bubbles by means of the cam 55—are disposed on the opposite and upper side of the switching member 73 with a partition wall 55*a* disposed therebetween. Accordingly, cabling of tubes, which extend from ports in the cover 76 of the switching member 73, below the partition wall 55*a* is facilitated.

(11) When the cam 55 stops immediately after a driven component, such as the reclosable member 50, is driven, there arises an apprehension that a load imparted from the driven component to the cam 55 may cause the cam 55 to stop at a position deviated from a predetermined position. However, in the embodiment, the switching member 73 is configured to be stored in the cover 76 having the ports 78 to 82 for air-discharging and suction, to include the switching channel 74 which can be brought into communication with the ports 78 to 82, and to slide while maintaining an airtight state with respect to the inner face of the cover 76. Thus, the switching member 73, which moves integrally with the cam 55, is configured to generate frictional resistance—caused by sliding—with respect to the cover 76. Therefore, the frictional resistance can stop the valve body 20 and the cam 55 at the predetermined position without fail.

(12) For the purpose of fixing positions of the ports 78 to 82 of the cover 76 in relation to the rotating switching member 73, the cover 76 must be maintained in a state where rotation of the cover 76 is restricted. However, in the embodiment, as means for restricting the rotation, the switching member 73 and the shaft 33 of the sun gear 32 for rotationally driving the cam 55 are utilized. Accordingly, the structure can be simplified as compared with a configuration including use of dedicated fixing means. In addition, since the cover 76 is held by the cam 55 by means of hooking with use of the retaining claws 83, the cover 76 can rotate in relation to the cam 55. Accordingly, the configuration does not impede the rotational operations of the cam 55 and the switching member 73.

(13) The reclosable member 50 advances from the valve-closing position to the valve-opening position in a lateral direction which crosses with the moving direction of the carriage 3, while being inserted in the corresponding discharge path 17 of the carriage 3, thereby closing the reclosable valve 19. Accordingly, when the carriage 3 moves to the home position (the maintenance position) in the state of being advanced to the valve-opening position, the carriage 3 interferes with the reclosable member 50. However, in the embodiment, when the carriage 3 is in the recording region 8 for performing recording on the recording medium, the reclosable member 50 is held at the valve-closing position; and when the carriage moves to the home position (the maintenance position) for discharging bubbles, the reclosable member 50 is allowed to advance to the valve-opening position. By virtue of the above configuration, the carriage 3 is prevented from interfering with the reclosable member 50 being advanced to the valve-opening position.

(14) During the course of the carriage 3 moving from the recording region 8 to the home position (the maintenance position), the carriage 3 pushes the air-discharge cap 40 at the receded position to the close-contact position. Accordingly, when the carriage 3 moves to the maintenance position, in accordance with the movement of the carriage 3, the air-discharge cap 40 can be brought into close contact with the carriage 3 at a good timing without additional disposition of means for synchronizing the motion of the carriage 3 with that of the air-discharge cap 40. In addition, since the carriage 3 pushes the air-discharge cap 40, a dedicated drive source for displacing the air-discharge cap 40 is obviated.

(15) During the course of the carriage 3 moving from the recording region 8 to the home position (the maintenance position), the carriage 3 pushes the nozzle cap 60 at the receded position to the close-contact position. Accordingly, when the carriage 3 moves to the maintenance position, in accordance with the movement of the carriage 3, the nozzle cap 60 can be brought into close contact with the carriage 3 at a good timing without additional disposition of means for synchronizing the motion of the carriage 3 with that of the nozzle cap 60. In addition, since the carriage 3 pushes the nozzle cap 60, a dedicated drive source for displacing the nozzle cap 60 is obviated.

(16) The home position of the carriage 3 (the home position) and the maintenance position are set on the same side with the wiper taken a border. In this case, when the carriage 3, on which the maintenance has been performed to the recording head 10, moves for performing recording on the recording medium, wiping operation is not required. Accordingly, in the embodiment, as means for returning the wiper 90 from the wiping position to the receded position, in addition to means making use of interference with the carriage 3, the release section which is engaged with the wiper 90, thereby displacing the wiper from the wiping position to the receded position, is formed on the cam 55. By virtue of the above configuration, the cam 55 is driven so as to cause the release section to move the wiper 90 from the wiping position to the receded position before the carriage 3 moves to the recording region 8. When, as described above, wiping of the recording head 10 by the wiper 90 is not required, by means of returning the wiper 90 to the receded position in advance, unnecessary contact between the wiper 90 and the recording head 10 can be prevented, thereby enhancing durability of the recording head 10.

(17) The release section 97*c* is configured so as to push the wiper 90 in a direction substantially parallel with the moving direction of the carriage 3, thereby releasing the wiper 90 from the latching section 93. More specifically, as means for returning the wiper 90 to the receded position, similar to the manner of the carriage 3 interfering with the wiper 90, the release section 97*c* pushes the wiper 90 in a direction to release the wiper 90 from the latching section 93. Accordingly, formation of a guide path on the cam 55 for forcibly displacing the wiper 90 to the receded position is obviated, thereby simplifying the structure of the cam 55.

(18) The cam 55 is configured so as to be driven to rotate by means of a gear mechanism engaged with the rotational drive mechanism for paper feed. More specifically, since a drive source for the cam 55 is common with that of the rotational drive mechanism for paper feed, the structure can be simplified.

(19) The cam 55 serving as means for moving the wiper 90 also serves as means for displacing the reclosable member 50 and means for displacing the carriage lock 100. Accordingly, the structure can be simplified.

(20) The stopper 92, located on the opposite side of the latching section 93 with the wiper 90 therebetween, is disposed on the maintenance frame 111. Accordingly, during the course of the carriage 3 moving to the home position (the maintenance position), when the carriage 3 interferes with the wiper 90 at the wiping position and displaces the wiper 90 in a direction to release the wiper 90 from the latching section 93, the wiper 90 abuts the stopper 92, thereby being restricted from excessive displacement. By virtue of the above configuration, the wiper 90 is prevented from unnecessarily interfering with another member.

(21) The wiper 90 is held at the wiping position where the wiper 90 is hooked by the latching section 93 by means of the urging means (the spring 95). Accordingly, the wiper 90 can be held at the wiping position without fail.

(22) The direction in which the spring 95 urges the wiper 90 is oblique to the moving direction (downward) of the wiper 90 from the wiping position to the receded position. Accordingly, the spring 95 also serves as the urging means for holding the wiper 90 in the state where the wiper 90 is hooked by the latching section 93, thereby enabling a reduction in the number of components.

OTHER EMBODIMENTS

The present invention is not limited to the embodiment having been described above by reference to the drawings. For instance, the following embodiments are also included in the scope of the invention. Furthermore, the present invention can be brought into actual use by means of adopting, instead of the following, various changes without departing from the spirit of the invention.

(1) In the above embodiment, as the means for returning the wiper to the receded position, a guide path for forcibly displacing the wiper to the receded position may be formed on the cam.

(2) In the above embodiment, the cam may be configured so as to slide instead of rotating.

(3) In the above embodiment, another drive source for the cam may be disposed in addition to the drive source for the rotational drive mechanism for paper feed.

(4) In the above embodiment, there may be disposed means for displacing the reclosable member in addition to the cam.

(5) In the above embodiment, means for displacing the carriage lock may be disposed in addition to the cam.

(6) In the above embodiment, urging means for holding the wiper in a state of being hooked by the latching section may be disposed in addition to the spring for urging the wiper to the receded position side.

As described with reference to the embodiment, there is provided an inkjet printer includes: a carriage having a recording head and moving reciprocatively along a moving path between a maintenance position and a recording position; a wiper disposed at a position along the moving path and performs a wiping operation to wipe the recording head to remove ink adhering to the recording head; and a cam that displaces the wiper between a receded position where the wiper recedes from the recording head and a wiping position where the wiper is brought into contact with the recording head to perform the wiping operation, wherein the wiper is retained in the wiping position to perform the wiping operation when the carriage moves from the maintenance position to the recording position, wherein the wiper interferes with the carriage and is displaced from the wiping position to the receded position when the carriage moves from the recording position to the maintenance position, and wherein the cam is provided with a release section that engages with the wiper and displaces the wiper from the wiping position to the receded position.

According to the above configuration, in a case where the wiper is taken as a border and a home position of the carriage and the maintenance position are set on the same side, when the carriage at the home position is moved for performing recording on a recording medium, the cam is desirably driven so as to cause the release section to move the wiper from the wiping position to the receded position before the carriage moves; and thereafter, the carriage is caused to start to move. When wiping of the recording head with use of the wiper is not required as described above, by means of returning the wiper to the receded position in advance, unnecessary contact between the wiper and the recording head can be prevented, thereby enhancing durability of the recording head.

In the embodiment, as means for returning the wiper to the receded position, similar to the manner in which the carriage interferes with the wiper, the release section is configured so as to push the wiper in a direction to release the wiper from the latching section. Accordingly, formation of a guide path for forcibly displacing the wiper to the receded position is negated. Consequently, the structure of the cam can be simplified.

In the embodiment, when the cam rotates, the wiper at the receded position climbs on the protuberance section, thereby being moved to the wiping position. When the cam rotates further and the release section interferes with the wiper, the wiper is released from the latching section, thereby being displaced from the wiping position to the receded position.

Since a drive source of the cam is common with that of the rotational drive mechanism for paper feed, the structure of the inkjet printer can be simplified.

Since the cam serving as means for moving the wiper also serves as means for displacing the reclosable member, the structure can be simplified.

Since the cam serving as the means for moving the wiper also serves as means for displacing the carriage lock, the structure can be simplified.

During the course of the carriage moving to the maintenance position, when the carriage interferes with the wiper at the wiping position and displaces the wiper in a direction to release the wiper from the latching section, the wiper abuts a stopper, thereby regulating excessive displacement. By virtue of the above configuration, the wiper is prevented from unnecessarily interfering with another member.

Since the wiper is held in a state of being hooked by the latching section by means of the urging means, the wiper can be held at the wiping position without fail.

Since the spring (urging member) for urging the wiper to the receded position also serves as the urging means for holding the wiper at the hooked stated on the latching section, the number of components can be reduced.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. An inkjet printer comprising:

a carriage that has a recording head and moves reciprocatively along a moving path between a maintenance position and a recording position;

a wiper disposed at a position along the moving path and performs a wiping operation to wipe the recording head to remove ink adhering to the recording head; and a cam that displaces the wiper between a receded position where the wiper recedes from the recording head and a wiping position where the wiper is brought into contact with the recording head to perform the wiping operation, wherein the wiper is retained in the wiping position to perform the wiping operation when the carriage moves from the maintenance position to the recording position, wherein the wiper interferes with the carriage and is displaced from the wiping position to the receded position when the carriage moves from the recording position to the maintenance position, and wherein the cam is provided with a release section that engages with the wiper and displaces the wiper from the wiping position to the receded position.

2. The inkjet printer according to claim 1, further comprising a latching section that engages with the wiper to retain the wiper in the wiping position.

3. The inkjet printer according to claim 2, wherein the cam displaces the wiper form the wiping position to the receded position by pushing the wiper with the release section in a direction substantially parallel to a moving direction of the carriage to release the wiper from the latching section.

4. The inkjet printer according to claim 2, wherein the cam is provided to be rotatable around a rotational axis, wherein the displacement direction of the wiper is configured to be substantially parallel to the rotational axis of the cam, wherein the cam is provided with an arc section formed concentric with the cam to retain the wiper at the receded position, and a protuberance section formed on a circumference whose diameter is substantially equal to that of the arc section, the protuberance section interfering with the wiper at the receded position and pushes the wiper to the wiping position, and wherein the release section is formed on a circumference whose diameter is substantially equal to that of the arc section, and interferes with the wiper at the wiping position in a radial direction to displace the wiper in a direction to release the wiper from the latching section.

5. The inkjet printer according to claim 4, further comprising a gear mechanism that engages with a rotational drive mechanism for feeding a recording medium on which the recording head records, the gear mechanism selectively driving to rotate the cam.

6. The inkjet printer according to claim 2, further comprising a wiper urging member that urges the wiper to the latching section.

7. The inkjet printer according to claim 6, further comprising an urging member that urges the wiper in a direction oblique to a moving direction of the wiper from the wiping position to the receded position to displace from the wiping position to the receded position, wherein the urging member also serves as the wiper urging member.

8. The inkjet printer according to claim 1, further comprising an urging member that urges the wiper to displace from the wiping position to the receded position.

9. The inkjet printer according to claim 1, wherein the carriage includes:

a bubble reservoir that stores bubbles generated in an ink channel for supplying ink to the recording head;

a reclosable valve disposed on a discharge path in communication with the bubble reservoir for discharging bubbles;

a reclosable member that discharges the bubbles from the bubble reservoir by opening the reclosable valve when the carriage is at the maintenance position; and a frame for supporting the reclosable member, and wherein the cam is provided with a cam guide that displaces the reclosable member between a valve-opening position for opening the reclosable valve and a valve-closing position for closing the reclosable valve.

10. The inkjet printer according to claim 9, wherein the frame is provided with a carriage lock that is displaced between a lock position where the carriage lock advances to the moving path of the carriage to hold the carriage at the maintenance position and a lock release position where the carriage lock retracts from the moving path of the carriage, and wherein the cam is provided with a cam guide that displaces the carriage lock between the lock position and the lock release position.

11. The inkjet printer according to claim 9, further comprising a latching section that engages with the wiper to retain the wiper in the wiping position, wherein the frame is provided with a stopper at a position opposite to the latching section with respect to the wiper.

12. The inkjet printer according to claim 1, wherein the wiper is disposed at a position along the moving path and between the maintenance position and the recording position.

13. The inkjet printer according to claim 1, wherein the release section of the cam displaces the wiper from the wiping position to the receded position when the carriage moves from the maintenance position to the recording position after a maintenance operation following the wiping operation is performed to the recording head at the maintenance position while the wiper is displaced to the wiping position.

14. An inkjet printer comprising:

a carriage that has a recording head and moves reciprocatively along a moving path between a maintenance position and a recording position;

a wiper disposed at a position along the moving path and between the maintenance position and the recording position, the wiper that performs a wiping operation to wipe the recording head to remove ink adhering to the recording head; and a cam that displaces the wiper between a receded position where the wiper recedes from the recording head and a wiping position where the wiper is brought into contact with the recording head to perform the wiping operation, wherein the wiper is retained in the wiping position to perform the wiping operation when the carriage moves from the maintenance position to the recording position, wherein the wiper interferes with the carriage and is displaced from the wiping position to the receded position when the carriage moves from the recording position to the maintenance position, and wherein the cam is provided with a release section that engages with the wiper and displaces the wiper from the wiping position to the receded position when the carriage moves from the maintenance position to the recording position after a maintenance operation following the wiping operation is performed to the recording head at the maintenance position while the wiper is displaced to the wiping position.

* * * * *